US006446037B1

(12) United States Patent
Fielder et al.

(10) Patent No.: US 6,446,037 B1
(45) Date of Patent: Sep. 3, 2002

(54) SCALABLE CODING METHOD FOR HIGH QUALITY AUDIO

(75) Inventors: Louis Dunn Fielder; Stephen Decker Vernon, both of San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 09/370,562

(22) Filed: Aug. 9, 1999

(51) Int. Cl.[7] ..... G10L 19/02

(52) U.S. Cl. ..... 704/229; 704/230; 704/501; 704/200.1; 704/226; 375/240; 375/253; 381/22; 381/23

(58) Field of Search ..... 704/500–504, 704/200.1, 226–230, 205, 206, 220–225, 201; 381/104, 2, 22, 23; 375/240, 253

(56) References Cited

U.S. PATENT DOCUMENTS

| | | | | | |
|---|---|---|---|---|---|
| 4,972,484 | A | | 11/1990 | Theile et al. | 381/37 |
| 5,253,055 | A | | 10/1993 | Civanlar et al. | 358/133 |
| 5,253,056 | A | | 10/1993 | Puri et al. | 358/133 |
| 5,270,813 | A | | 12/1993 | Puri et al. | 358/136 |
| 5,530,655 | A | * | 6/1996 | Lokhoff et al. | 375/240.03 |
| 5,537,510 | A | * | 7/1996 | Kim | 704/229 |
| 5,640,486 | A | * | 6/1997 | Lim | 704/200.1 |
| 5,712,920 | A | * | 1/1998 | Spille | 381/104 |
| 5,721,806 | A | * | 2/1998 | Lee | 704/222 |
| 5,812,672 | A | * | 9/1998 | Herre et al. | 381/2 |
| 5,832,427 | A | * | 11/1998 | Shibuya | 704/205 |
| 5,930,750 | A | * | 7/1999 | Tsutsui | 704/229 |
| 6,092,041 | A | * | 7/2000 | Pan et al. | 704/229 |
| 6,094,636 | A | * | 7/2000 | Kim | 704/229 |
| 6,108,625 | A | * | 8/2000 | Kim | 704/201 |
| 6,349,284 | B1 | * | 2/2002 | Park et al. | 704/230 |

FOREIGN PATENT DOCUMENTS

| | | | |
|---|---|---|---|
| AU | 9669248 | 4/1997 | H04B/1/66 |
| AU | 9855571 | 9/1998 | G10L/9/14 |
| EP | 0734021 | 9/1996 | G11B/20/10 |
| EP | 0869622 | 10/1998 | H04B/1/66 |
| EP | 0884850 | 12/1998 | H03M/7/30 |
| EP | 0918401 | 5/1999 | H04B/1/66 |
| EP | 0918407 | 5/1999 | H04H/1/00 |
| EP | 0919989 | 6/1999 | G10L/9/18 |
| GB | 2320870 | 7/1998 | H04L/25/02 |

OTHER PUBLICATIONS

Advanced Television System Committee (ATSC), "Digital Audio Compression Standard (AC–3)," Document A/52, pp. i–vii and 1–130, USA, Dec. 1995.

ISO/IEC 11172–3:1993, "Information technology–Coding of moving pictures and associated audio for digital storage media at up to about, 1,5 Mbit/s– Part 3: Audio" pp. i–v and 1–150, Genmeve, Switzerland, (Aug. 1993).

(List continued on next page.)

*Primary Examiner*—Vijay B Chawan
(74) *Attorney, Agent, or Firm*—David N. Lathrop, Esq.; Gallagher & Lathrop

(57) ABSTRACT

Scalable coding of audio into a core layer in response to a desired noise spectrum established according to psychoacoustic principles supports coding augmentation data into augmentation layers in response to various criteria including offset of such desired noise spectrum. Compatible decoding provides a plurality of decoded resolutions from a single signal. Coding is preferably performed on subband signals generated according to spectral transform, quadrature mirror filtering, or other conventional processing of audio input. A scalable data structure for audio transmission includes core and augmentation layers, the former for carrying a first coding of an audio signal that places post decode noise beneath a desired noise spectrum, the later for carrying offset data regarding the desired noise spectrum and data about coding of the audio signal that places post decode noise beneath the desired noise spectrum shifted by the offset data.

56 Claims, 7 Drawing Sheets

OTHER PUBLICATIONS

G. Stoll, M. Link and G. Thelie, "Masking–pattern adapted subband coding: use of the dynamic bit–rate margin," presented at the 84th Convention of the Audio Engineering Society, Paris, France, Preprint 2585, pp. 1–33, (Mar. 1988).

J. Stautner, "Scalable Audio Compression for Mixed Computing Environments," presented at the 93rd Convention of the Audio Engineering Society, San Francisco, California, Preprint 3357, pp. 1–6, Figs. 1–3, Table 1, (Oct. 1992).

P. Tudor and N. Wells, "Scalable source coding for HDTV," from Audio and Video Digital Radio Broadcasting Systems and Techniques, pp. 131–142, Elsevier Science BV, Surrey, United Kingdom, (1994).

ISO/IEC 13818–3:1998(E), "Information Technology—Generic coding of moving pictures and associated audio information –Part 3: Audio," pp. i–x and 1–115, Genṁeva, Switzerland, (Apr. 1998).

K. Brandenburg and B. Grill, "First Ideas on Scalable Audio Coding," presented at the 97th Convention of the Audio Engineering Society, San Francisco, California, Preprint 3924, pp. 1–6, Figs. 1–3, and Table 1, (Nov. 1994).

B. Grill and K. Brandenburg, "A Two– or Three–Stage Bit Rate Scalable Audio Coding System," presented at the 99th Convention of the Audio Engineering Society, New York, NY, Preprint 4132, pp. 1–7, Figs. 1–3, (Oct. 1995).

B. Grill, "A Bit Rate Scalable Perceptual Coder for MPEG–4 Audio," presented at the 103rd Convention of the Audio Engineering Society, New York, NY, Preprint 4620, pp. 1–16 and Fig. 1–8, (Sep. 1997).

S. Park, Y. Kim, S. Kim and Y. Seo, "Multi–Layer Bit–Sliced Bit–Rate Scalable Audio Coding," presented at the 103rd Convention of the Audio Engineering Society, New York, NY, Preprint 4520, pp. 1–11, (Sep. 1997).

P. Kudumakis and M. Sandler, "Wavelet Packet Based Scalable Audio Coding," Proceedings of the IEEE International Symposium on Circuits and Systems, Atlanta, vol. 2, pp. 41–44, (May 1996).

Y. Nakajima, H. Yanagihara, A. Yoneyama and M. Sugano, "MPEG Audio Bit Rate Scaling on Coded Data Domain," Proceedings of the 1998 IEEE International Conference on Acoustics, Speech and Signal Processing, vol. 6, pp. 3669–3672, (1998).

G. Davidson, L. Fielder and B. Link, "Parametric Bit Allocation in a Perceptual Audio Coder," presented at the 97th Convention of the Audio Engineering Society, San Francisco, California, Preprint 3921, pp. 1–15 and Figs. 1–9, (Nov. 1994).

A. Jin, T. Moriya, T. Norimatsu, M. Tsushima and T. Ishikawa, "Scalable Audio Coder Based on Quantizer Units of MDCT Coefficients," presented at the International Conference on Acoustics, Speech and Signal Processing, Phoenix, (May 1999).

* cited by examiner

SCALABLE CODING METHOD FOR HIGH QUALITY AUDIO

TECHNICAL FIELD

The present invention relates to audio coding and decoding and relates more particularly to scalable coding of audio data into a plurality of layers of a standard data channel and scalable decoding of audio data from a standard data channel.

BACKGROUND ART

Due in part to the widespread commercial success of compact disc (CD) technologies over the last two decades, sixteen bit pulse code modulation (PCM) has become an industry standard for distribution and playback of recorded audio. Over much of this time period, the audio industry touted the compact disc as providing superior sound quality to vinyl records and cassette tapes, and many people believed that little audible benefit would be obtained by increasing the resolution of audio beyond that obtainable from sixteen bit PCM.

Over the last several years, this belief has been challenged for various reasons. The dynamic range of sixteen bit PCM is too limited for noise free reproduction of all musical sounds. Subtle detail is lost when audio is quantized to sixteen bit PCM. Moreover, the belief may fail to consider the practice of reducing quantization resolutions to provide additional headroom at the cost of reducing the signal-to-noise ratio and lowering signal resolution. Due to such concerns, there currently is strong commercial demand for audio processes that provide improved signal resolution relative to sixteen bit PCM.

There currently is also strong commercial demand for multi-channel audio. Multi-channel audio provides multiple channels of audio which can improve spatialization of reproduced sound relative to traditional mono and stereo techniques. Common systems provide for separate left and right channels both in front of and behind a listening field, and may also provide for a center channel and subwoofer channel. Recent modifications have provided numerous audio channels surrounding a listening field for reproducing or synthesizing spatial separation of different types of audio data.

Perceptual coding is one variety of techniques for improving the perceived resolution of an audio signal relative to PCM signals of comparable bit rate. Perceptual coding can reduce the bit rate of an encoded signal while preserving the subjective quality of the audio recovered from the encoded signal by removing information that is deemed to be irrelevant to the preservation of that subjective quality. This can be done by splitting an audio signal into frequency subband signals and quantizing each subband signal at a quantizing resolution that introduces a level of quantization noise that is low enough to be masked by the decoded signal itself. Within the constraints of a given bit rate, an increase in perceived signal resolution relative to a first PCM signal of given resolution can be achieved by perceptually coding a second PCM signal of higher resolution to reduce the bit rate of the encoded signal to essentially that of the first PCM signal. The coded version of the second PCM signal may then be used in place of the first PCM signal and decoded at the time of playback.

One example of perceptual coding is embodied in devices that conform to the public ATSC AC-3 bitstream specification as specified in the Advanced Television Standards Committee (ATSC) A52 document (1994). This particular perceptual coding technique as well as other perceptual coding techniques are embodied in various versions of Dolby Digital® coders and decoders. These coders and decoders are commercially available from Dolby Laboratories, Inc. of San Francisco, California. Another example of a perceptual coding technique is embodied in devices that conform to the MPEG-1 audio coding standard ISO 11172-3 (1993).

One disadvantage of conventional perceptual coding techniques is that the bit rate of the perceptually coded signal for a given level of subjective quality may exceed the available data capacity of communication channels and storage media. For example, the perceptual coding of a twenty-four bit PCM audio signal may yield a perceptually coded signal that requires more data capacity than is provided by a sixteen bit wide data channel. Attempts to reduce the bit rate of the encoded signal to a lower level may degrade the subjective quality of audio that can be recovered from the encoded signal. Another disadvantage of conventional perceptual coding techniques is that they do not support the decoding of a single perceptually coded signal to recover an audio signal at more than one level of subjective quality.

Scalable coding is one technique that can provide a range of decoding quality. Scalable coding uses the data in one or more lower resolution codings together with augmentation data to supply a higher resolution coding of an audio signal. Lower resolution codings and the augmentation data may be supplied in a plurality of layers. There is also strong need for scalable perceptual coding, and particularly, for scalable perceptual coding that is backward compatible at the decoding stage with commercially available sixteen bit digital signal transport or storage means.

DISCLOSURE OF INVENTION

Scalable audio coding is disclosed that supports coding of audio data into a core layer of a data channel in response to a first desired noise spectrum. The first desired noise spectrum preferably is established according to psychoacoustic and data capacity criteria. Augmentation data may be coded into one or more augmentation layers of the data channel in response to additional desired noise spectra. Alternative criteria such as conventional uniform quantization may be utilized for coding augmentation data.

Systems and methods for decoding just a core layer of a data channel are disclosed. Systems and methods for decoding both a core layer and one or more augmentation layers of a data channel are also disclosed, and these provide improved audio quality relative to that obtained by decoding just the core layer.

Some embodiments of the present invention are applied to subband signals. As is understood in the art, subband signals may be generated in numerous ways including the application of digital filters such as the quadrature mirror filter, and by a wide variety of time-domain to frequency-domain transforms and wavelet transforms.

Data channels employed by the present invention preferably have a sixteen bit wide core layer and two four bit wide augmentation layers conforming to standard AES3 which is published by the Audio Engineering Society (AES). This standard is also known as standard ANSI S4.40 by the American National Standard Institute (ANSI). Such a data channel is referred to herein as a standard AES3 data channel.

Scalable audio coding and decoding according to various aspects of the present invention can be implemented by discrete logic components, one or more ASICs, program-controlled processors, and by other commercially available components. The manner in which these components are implemented is not important to the present invention. Preferred embodiments use program-controlled processors, such as those in the DSP563xx line of digital signal processors from Motorola. Programs for such implementations may include instructions conveyed by machine readable media, such as, baseband or modulated communication paths and storage media. Communication paths preferably are in the spectrum from supersonic to ultraviolet frequencies. Essentially any magnetic or optical recording technology may be used as storage media, including magnetic tape, magnetic disk, and optical disc.

According to various aspects of the present invention, audio information coded according to the present invention can be conveyed by such machine readable media to routers, decoders, and other processors, and may be stored by such machine readable media for routing, decoding, or other processing at later times. In preferred embodiments, audio information is coded according to the present invention, and stored on machine readable media, such as compact disc. Such data preferably is formatted in accordance with various frame and/or other disclosed data structures. A decoder can then read the stored information at later times for decoding and playback. Such decoder need not include encoding functionality.

Scalable coding processes according to one aspect of the present invention utilize a data channel having a core layer and one or more augmentation layers. A plurality of subband signals are received. A respective first quantization resolution for each subband signal is determined in response to a first desired noise spectrum, and each subband signal is quantized according to the respective first quantization resolution to generate a first coded signal. A respective second quantization resolution is determined for each subband signal in response to a second desired noise spectrum, and each subband signal is quantized according to the respective second quantization resolution to generate a second coded signal. A residue signal is generated that indicates a residue between the first and second coded signals. The first coded signal is output in the core layer, and the residue signal is output in the augmentation layer.

According to another aspect of the present invention, a process of coding an audio signal uses a standard data channel that has a plurality of layers. A plurality of subband signals are received. A perceptual coding and second coding of the subband signals are generated. A residue signal that indicates a residue of the second coding relative to the perceptual coding is generated. The perceptual coding is output in a first layer of the data channel, and the residue signal is output in a second layer of the data channel.

According to another aspect of the present invention, a processing system for a standard data channel includes a memory unit and a program-controlled processor. The memory unit stores a program of instructions for coding audio information according to the present invention. The program-controlled processor is coupled to the memory unit for receiving the program of instructions, and is further coupled to receive a plurality of subband signals for processing. Responsive to the program of instructions, the program controlled processor processes the subband signals in accordance with the present invention. In one embodiment, this comprises outputting a first coded or perceptually coded signal in one layer of the data channel, and outputting a residue signal in another layer of the data channel, for example, in accordance with the scalable coding process disclosed above.

According to another aspect of the present invention, a method of processing data uses a multi-layer data channel having a first layer that carries a perceptual coding of an audio signal and having a second layer that carries augmentation data for increasing the resolution of the perceptual coding of the audio signal. According to the method, the perceptual coding of the audio signal and the augmentation data are received via the data channel. The perceptual coding is routed to a decoder or other processor for further processing. This may include decoding of the perceptual coding, without further consideration of the augmentation data, to yield a first decoded signal. Alternatively, the augmentation data can be routed to the decoder or other processor, and therein combined with the perceptual coding to generate a second coded signal, which is decoded to yield a second decoded signal having higher resolution than the first decoded signal.

According to another aspect of the present invention, a processing system for processing data on a multi-layer data channel is disclosed. The multi-layer data channel has a first layer that carries a perceptual coding of an audio signal and a second layer that carries augmentation data for increasing the resolution of the perceptual coding of the audio signal. The processing system includes signal routing circuitry, a memory unit, and a program-controlled processor. The signal routing circuitry receives the perceptual coding and augmentation data via the data channel, and routes the perceptual coding and optionally the augmentation data to the program-controlled processor. The memory unit stores a program of instructions for processing audio information according to the present invention. The program-controlled processor is coupled to the signal routing circuitry for receiving the perceptual coding, and is coupled to the memory unit for receiving the program of instructions. Responsive to the program of instructions, the program controlled processor processes the perceptual coding and optionally the augmentation data according to the present invention. In one embodiment, this comprises routing and decoding of one or more layers of information as disclosed above.

According to another aspect of the present invention, a machine readable medium carries a program of instructions executable by a machine to perform a coding process according to the present invention. According to another aspect of the present invention, a machine readable medium carries a program of instructions executable by a machine to perform a method of routing and/or decoding data carried by a multi-layer data channel in accordance with the present invention. Examples of such coding, routing, and decoding are disclosed above and in the detailed description below. According to another aspect of the present invention, a machine readable medium carries coded audio information coded according to the present invention, such as any information processed in accordance with a disclosed process or method.

According to another aspect of the present invention, coding and decoding processes of the present invention may be implemented in a variety of manners. For example, a program of instructions executable by a machine, such as a programmable digital signal processor or computer processor, to perform such a process can be conveyed by a medium readable by the machine, and the machine can read the medium to obtain the program and responsive thereto perform such process. The machine may be dedicated to performing only a portion of such processes, for example, by only conveying corresponding program material via such medium.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

Figure 1A:
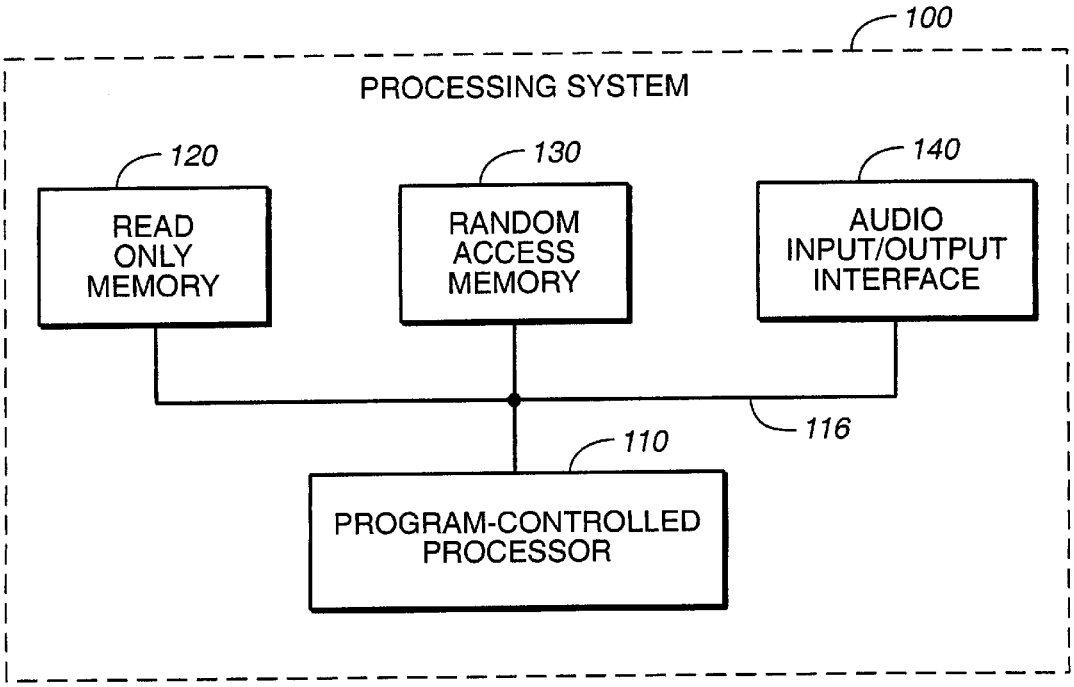
FIG. 1A is a schematic block diagram of processing system for coding and/or decoding audio signals that includes a dedicated digital signal processor.

The present invention relates to scalable coding of audio signals. Scalable coding uses a data channel that has a plurality of layers. These include a core layer for carrying data that represents an audio signal according to a first resolution and one or more augmentation layers for carrying data that in combination with the data carried in the core layer represents the audio signal according to a higher resolution. The present invention may be applied to audio subband signals. Each subband signal typically represents a frequency band of audio spectrum. These frequency bands may overlap one another. Each subband signal typically comprises one or more subband signal elements.

Subband signals may be generated by various techniques. One technique is to apply a spectral transform to audio data to generate subband signal elements in a spectral-domain. One or more adjacent subband signal elements may be assembled into groups to define the subband signals. The number and identity of subband signal elements forming a given subband signal can be predetermined or alternatively can be based on characteristics of the audio data encoded. Examples of suitable spectral transforms include the Discrete Fourier Transform (DFT) and various Discrete Cosine Transforms (DCT) including a particular Modified Discrete Cosine Transform (MDCT) sometimes referred to as a Time-Domain Aliasing Cancellation (TDAC) transform, which is described in Princen, Johnson and Bradley, "Subband/Transform Coding Using Filter Bank Designs Based on Time Domain Aliasing Cancellation," *Proc. Int. Conf. Acoust., Speech, and Signal Proc.*, May 1987, pp. 2161–2164. Another technique for generating subband signals is to apply a cascaded set of quadrature mirror filters (QMF) or some other bandpass filter to audio data to generate subband signals. Although the choice of implementation may have a profound effect on the performance of a coding system, no particular implementation is important in concept to the present invention.

The term "subband" is used herein to refer to a portion of the bandwidth of an audio signal. The term "subband signal" is used herein to refer to a signal that represents a subband. The term "subband signal element" is used herein to refer to elements or components of a subband signal. In implementations that use a spectral transform, for example, subband signal elements are the transform coefficients. For simplicity, the generation of subband signals is referred to herein as subband filtering regardless whether such signal generation is accomplished by the application of a spectral transform or other type of filter. The filter itself is referred to herein as a filter bank or more particularly an analysis filter bank. In conventional manner, a synthesis filter bank refers to an inverse or substantial inverse of an analysis filter bank.

Error correction information may be supplied for detecting one or more errors in data processed in accordance with the present invention. Errors may arise, for example, during transmission or buffering of such data, and it is often beneficial to detect such errors and correct the data appropriately prior to playback of the data. The term error correction refers to essentially any error detection and/or correction scheme such as parity bits, cyclic redundancy codes, checksums and Reed-Solomon codes.

Referring now to FIG. 1A there is shown a schematic block diagram of an embodiment of processing system 100 for encoding and decoding audio data according to the present invention. Processing system 100 comprises program-controlled processor 110, read only memory 120, random access memory 130, audio input/output interface 140 interconnected in conventional manner by bus 116. The program-controlled processor 110 is a model DSP563xx digital signal processor that is commercially available from Motorola. The read only memory 120 and random access memory 130 are of conventional design. The read only memory 120 stores a program of instructions which allows the program-controlled processor 110 to perform analysis and synthesis filtration and to process audio signals as described with respect to FIGS. 2A through 7D. The program remains intact in the read only memory 120 while the processing system 100 is in a powered down state. The read only memory 120 may alternatively be replaced by virtually any magnetic or optical recording technology, such as those using a magnetic tape, a magnetic disk, or an optical disc, according to the present invention. The random access memory 130 buffers instructions and data, including received and processed signals, for the program-controlled processor 110 in conventional manner. The audio input/output interface 140 includes signal routing circuitry for routing one or more layers of received signals to other components, such as the program-controlled processor 110.

The signal routing circuitry may include separate terminals for input and output signals, or alternatively, may use the same terminal for both input and output. Processing system 100 may alternatively be dedicated to encoding by omitting the synthesis and decoding instructions, or alternatively dedicated to decoding by omitting the analysis and encoding instructions. Processing system 100 is a representation of typical processing operations beneficial for implementing the present invention, and is not intended to portray a particular hardware implementation thereof.

To perform encoding, the program-controlled processor 110 accesses a program of coding instructions from the read only memory 120. An audio signal is supplied to the processing system 100 at audio input/output interface 140, and routed to the program-controlled processor 110 to be encoded. Responsive to the program of coding instructions, the audio signal is filtered by an analysis filter bank to generate subband signals, and the subband signals are coded to a generate coded signal. The coded signal is supplied to other devices through the audio input/output interface 140, or alternatively, is stored in random access memory 130.

To perform decoding, the program-controlled processor 110 accesses a program of decoding instructions from the read only memory 120. An audio signal which preferably has been coded according to the present invention is supplied to the processing system 100 at audio input/output interface 140, and routed to the program-controlled processor 110 to be decoded. Responsive to the program of decoding instructions, the audio signal is decoded to obtain corresponding subband signals, and the subband signals are filtered by a synthesis filter bank to obtain an output signal. The output signal is supplied to other devices through the audio input/output interface 140, or alternatively, is stored in random access memory 130.

Figure 1B:
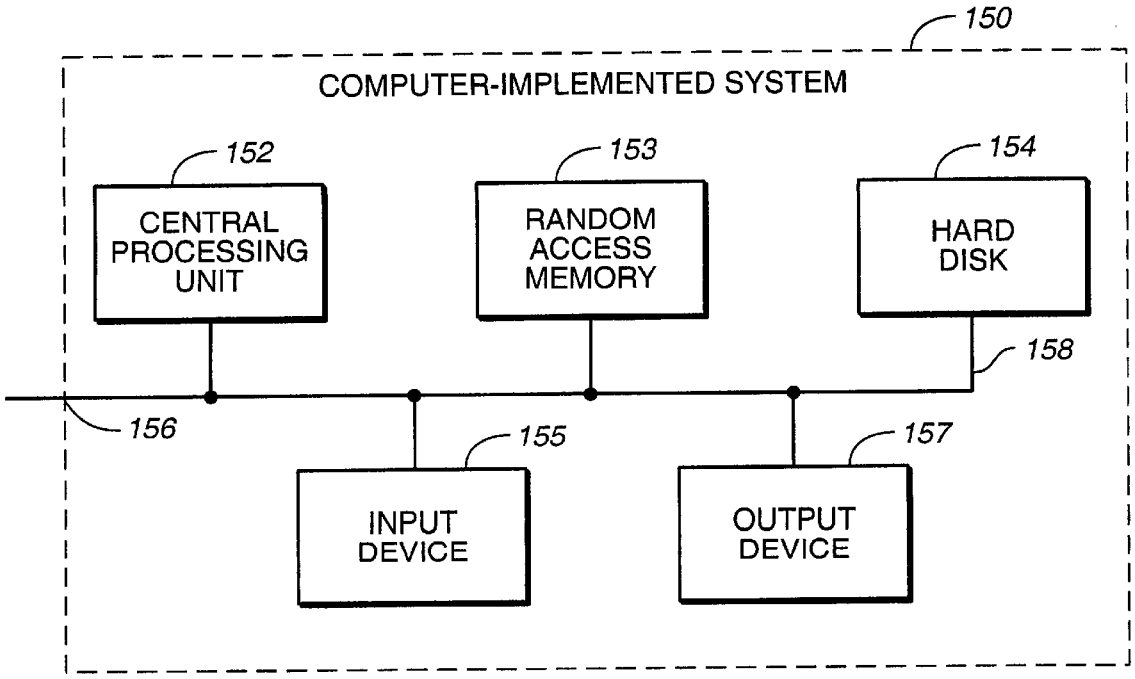
FIG. 1B is a schematic block diagram of a computer-implemented system for coding and/or decoding audio signals.

Referring now also to FIG. 1B, there is shown a schematic block diagram of an embodiment of a computer-implemented system 150 for encoding and decoding audio signals according to the present invention. Computer-implemented system 150 includes a central processing unit 152, random access memory 153, hard disk 154, input device 155, terminal 156, output device 157, interconnected in conventional manner by bus 158. Central processing unit 152 preferably implements Intel® x86 instruction set architecture and preferably includes hardware support for implementing floating-point arithmetic processes, and may, for example, be an Intel® Pentium® III microprocessor which is commercially available from Intel® Corporation of Santa Clara Calif. Audio information is provided to the computer-implemented system 150 via terminal 156, and routed to the central processing unit 152. A program of instructions stored on hard disk 154 allows computer-implemented system 150 to process the audio data in accordance with the present invention. Processed audio data in digital form is then supplied via terminal 156, or alternatively written to and stored in the hard disk 154.

It is anticipated that processing system 100, computer-implemented system 150, and other embodiments of the present invention will be used in applications that may include both audio and video processing. A typical video application would synchronize its operation with a video clocking signal and an audio clocking signal. The video clocking signal provides a synchronization reference with video frames. Video clocking signals could provide reference, for example, frames of NTSC, PAL, or ATSC video signals. The audio clocking signal provides synchronization reference to audio samples. Clocking signals may have substantially any rate. For example, 48 kilohertz is a common audio clocking rate in professional applications. No particular clocking signal or clocking signal rate is important for practicing the present invention.

Figure 2A:
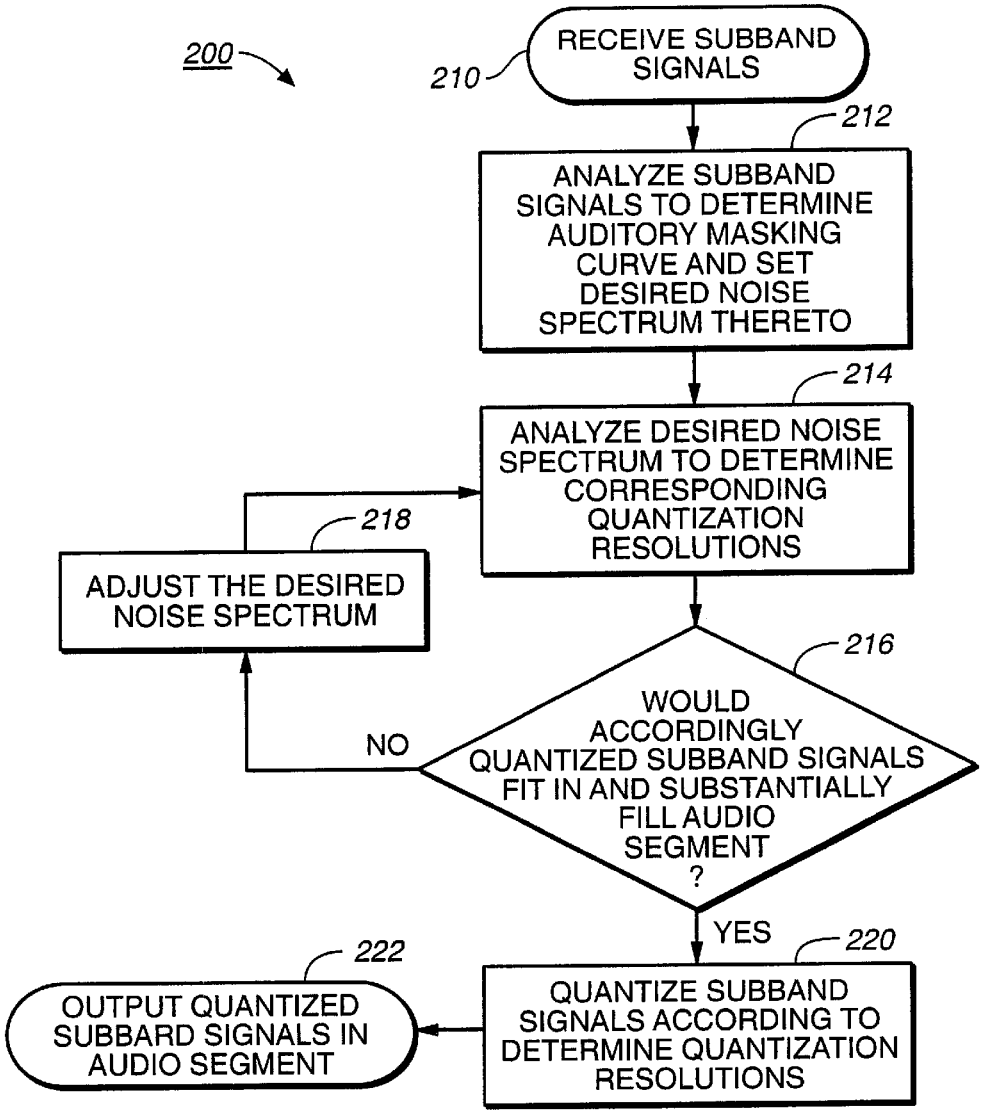
FIG. 2A is a flowchart of a process for coding an audio channel according to psychoacoustic principles and a data capacity criterion.
Figure 2B:
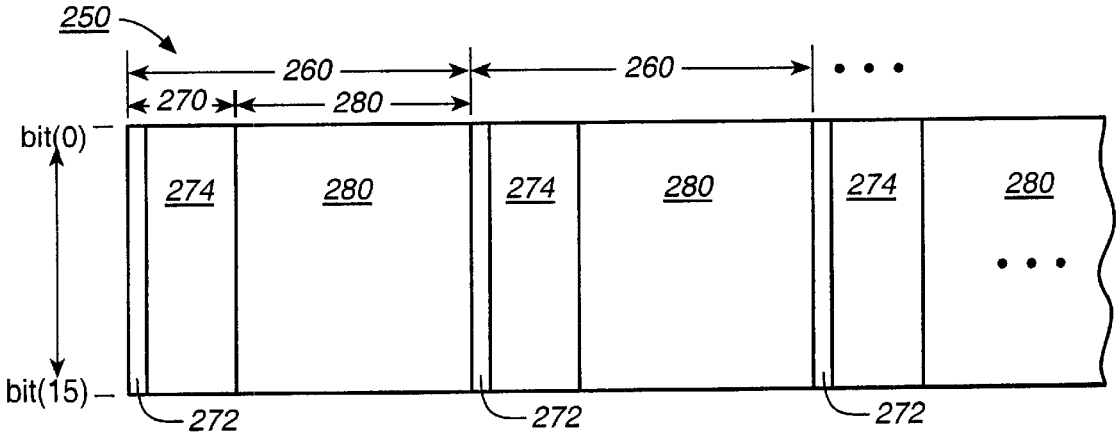
FIG. 2B is a schematic diagram of a data channel that comprises a sequence of frames, each frame comprising a sequence of words, each word being sixteen bits wide.

Referring now to FIG. 2A there is shown a flowchart of a process 200 that codes audio data into a data channel according to psychoacoustic and data capacity criteria. Referring now also to FIG. 2B there is shown a block diagram of the data channel 250. Data channel 250 comprises a sequence of frames 260, each frame 260 comprising a sequence of words. Each word is designated as sequence of bits (n) where n is an integer between zero and fifteen inclusive, and where the notation bits (n~m) represents bit (n) through bit (m) of the word. Each frame 260 includes a control segment 270 and an audio segment 280, each comprising a respective integer number of the words of the frame 260.

A plurality of subband signals are received 210 that represent a first block of an audio signal. Each subband signal comprises one or more subband elements, and each subband element is represented by one word. The subband signals are analyzed 212 to determine an auditory masking curve. The auditory masking curve indicates the maximum amount of noise that can be injected into each respective subband without becoming audible. What is audible in this respect is based on psychoacoustic models of human hearing and may involve cross-channel masking characteristics where the subband signals represent more than one audio channel. The auditory masking curve serves as a first estimate of a desired noise spectrum. The desired noise spectrum is analyzed 214 to determine a respective quantization resolution for each subband signal such that when the subband signals are quantized accordingly and then dequantized and converted into sound waves, the resulting coding noise is beneath the desired noise spectrum. A determination 216 is made whether accordingly quantized subband signals can be fit within and substantially fill the audio segment 280. If not, the desired noise spectrum is adjusted 218 and steps 214, 216 are repeated. If so, the subband signals are accordingly quantized 220 and output 222 in the audio segment 280.

Control data is generated for the control segment 270 of frame 260. This includes a synchronization pattern that is output in the first word 272 of the control segment 270. The synchronization pattern allows decoders to synchronize to sequential frames 260 in the data channel 250. Additional control data that indicates the frame rate of frames 260, boundaries of segments 270, parameters of coding operations, and error detection information are output in the remaining portion 274 of the control segment 270. This process may be repeated for each block of the audio signal, with each sequential block preferably being coded into a corresponding sequential frame 260 of the data channel 250.

Process 200 can be applied to coding data into one or more layers of a multi-layer audio channel. Where more than one layer is coded according to process 200 there is likely to be substantial correlation between the data carried in such layers, and accordingly substantial waste of data capacity of the multi-layer audio channel. Discussed below are scalable processes that output augmentation data into a second layer of a data channel to improve the resolution of data carried in a first layer of such data channel. Preferably, the improvement in resolution can be expressed as a functional relationship of coding parameters of the first layer, such as an offset that when applied to the desired noise spectrum used for coding the first layer yields a second desired noise spectrum used for coding the second layer. Such offset may then be output in an established location of the data channel, such as in a field or segment of the second layer, to indicate to decoders the value of the improvement. This may then be used to determine the location of each subband signal element or information relating thereto in the second layer. Next addressed are frame structures for organizing scalable data channels accordingly.

Figure 3A:
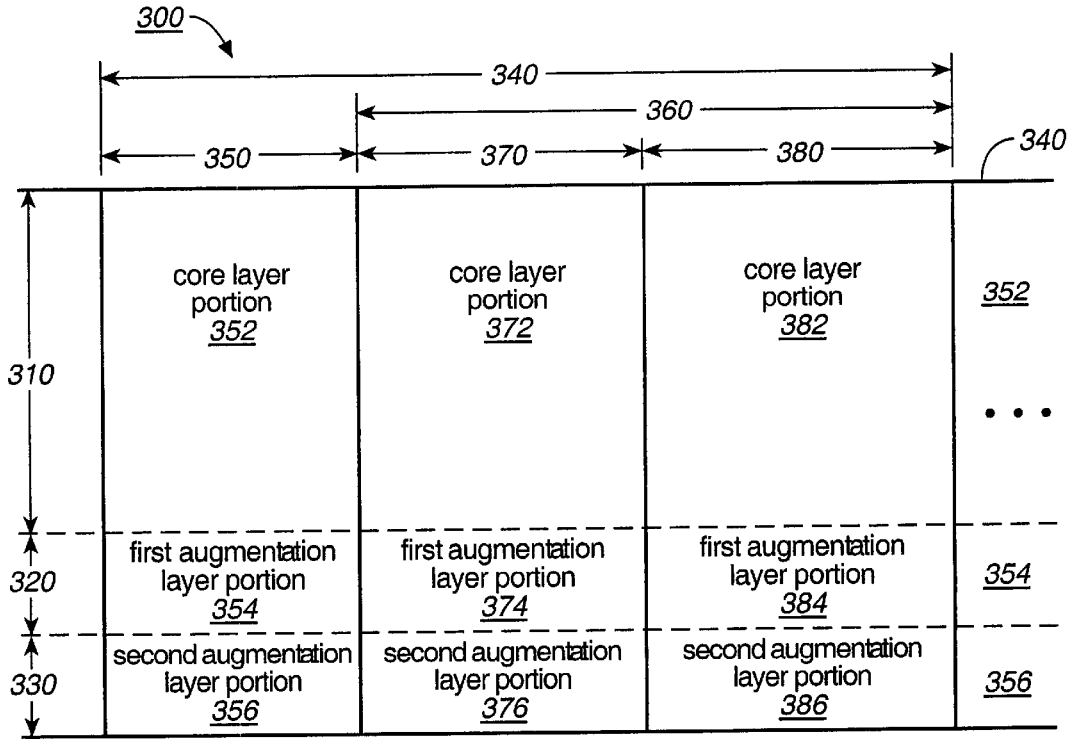
FIG. 3A is a schematic diagram of a scalable data channel that includes a plurality of layers that are organized as frames, segments, and portions.

Referring now to FIG. 3A, there is shown a schematic diagram of an embodiment of a scalable data channel 300 that includes core layer 310, first augmentation layer 320, and second augmentation layer 330. Core layer 310 is L bits wide, first augmentation layer 320 is M bits wide, and second augmentation layer 330 is N bits wide, with L, M, N being positive integer values. The core layer 310 comprises a sequence of L-bit words. The combination of the core layer 310 and the first augmentation layer 320 comprises a sequence of (L+N)-bit words, and the combination of core layer 310, first augmentation layer 320 and second augmentation layer 330 comprises a sequence of (L+M+N)-bit words. The notation bits (n~m) is used herein to represent bits (n) through (m) of a word, where n and m are integers and m>n, and where m, n can be between zero and twenty-three inclusive. Scalable data channel 300 may, for example, be a twenty-four bit wide standard AES3 data channel with L, M, N equal to sixteen, four, and four respectively.

Scalable data channel 300 may be organized as a sequence of frames 340 according to the present invention. Each frame 340 is partitioned into a control segment 350 followed by an audio segment 360. Control segment 350 includes core layer portion 352 defined by the intersection of the control segment 350 with the core layer 310, first augmentation layer portion 354 defined by the intersection of the control segment 350 with the first augmentation layer 320, and second augmentation layer portion 356 defined by the intersection of the intersection of the control segment 350 with the second augmentation layer 330. The audio segment 360 includes first and second subsegments 370, 380. The first subsegment 370 includes a core layer portion 372 defined by the intersection of the first subsegment 370 with the core layer 310, a first augmentation layer portion 374 defined by the intersection of the first subsegment 370 with the first augmentation layer 320, and a second augmentation layer portion 376 defined by the intersection of the first subsegment 370 with the second augmentation layer 330. Similarly, the second subsegment 380 includes a core layer portion 382 defined by the intersection of the second subsegment 380 with the core layer 310, a first augmentation layer portion 384 defined by the intersection of the second subsegment 380 with the first augmentation layer 320, and a second augmentation layer portion 386 defined by the intersection of the second subsegment 380 with the second augmentation layer 330.

In this embodiment, core layer portions 372, 382 carry coded audio data that is compressed according to psychoacoustic criteria so that the coded audio data fits within core layer 310. Audio data that is provided as input to the coding process may, for example, comprise subband signal elements each represented by a P bit wide word, with integer P being greater than L. Psychoacoustic principles may then be applied to code the subband signal elements into encoded values or "symbols" having an average width of about L bits. The data volume occupied by the subband signal elements is thereby compressed sufficiently that it can be conveniently transmitted via the core layer 310. Coding operations preferably are consistent with conventional audio transmission criteria for audio data on an L bit wide data channel so that core layer 310 can be decoded in a conventional manner. First augmentation layer portions 374, 384 carry augmentation data that can be used in combination with the coded information in core layer 310 to recover an audio signal having a higher resolution than can be recovered from only the coded information in core layer 310. Second augmentation layer portions 376, 386 carry additional augmentation data that can be used in combination with the coded information in core layer 310 and first augmentation layer 320 to recover an audio signal having a higher resolution than can be recovered from only the coded information carried in a union of core layer 310 with first augmentation layer 320. In this embodiment, the first subsegment 370 carries coded audio data for a left audio channel CH_L, and the second subsegment 380 carries coded audio data for a right audio channel CH_R.

Core layer portion 352 of control segment 350 carries control data for controlling operation of decoding processes. Such control data may include synchronization data that indicates the location of the beginning of the frame 340, format data that indicates program configuration and frame rate, segment data that indicates boundaries of segments and subsegments within the frame 340, parameter data that indicates parameters of coding operations, and error detection information that protects data in core layer portion 352. Predetermined or established locations preferably are provided in core layer portion 352 for each variety of control data to allow decoders to quickly parse each variety from the core layer portion 352. According to this embodiment, all control data that is essential for decoding and processing the core layer 310 is included in core layer portion 352. This allows augmentation layers 320, 330 to be stripped off or discarded, for example by signal routing circuitry, without loss of essential control data, and thereby supports compatibility with digital signal processors designed to receive data formatted as L-bit words. Additional control data for augmentation layers 320, 330 can be included in augmentation layer portion 354 according to this embodiment.

Within control segment 350, each layer 310, 320, 330 preferably carries parameters and other information for decoding respective portions of the encoded audio data in audio segment 360. For example, core layer portion 352 can carry an offset of an auditory masking curve that yields a first desired noise spectrum used for perceptually coding information into core layer portions 372, 382. Similarly, the first augmentation layer portion 354 can carry an offset of the first desired noise spectrum that yields a second desired noise spectrum used for coding information into augmentation layer portions 374, 384, and the second augmentation layer portion 356 can carry an offset of the second desired noise spectrum that yields a third desired noise spectrum used for coding information into the second augmentation layer portions 376, 386.

Figure 3B:
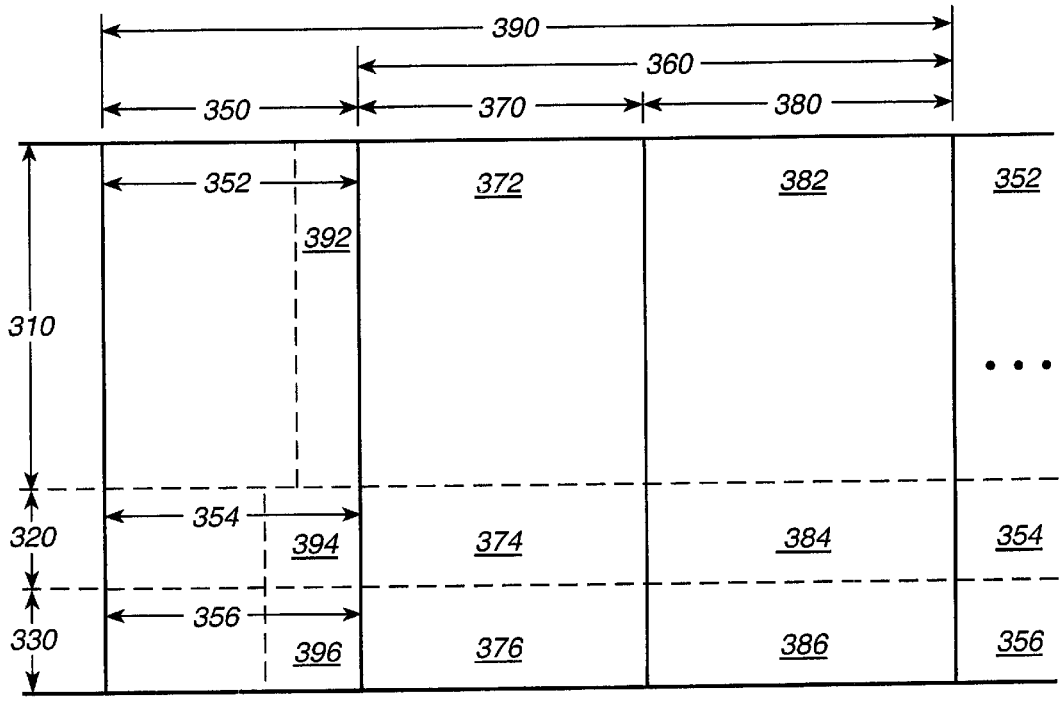
FIG. 3B is a schematic diagram of a frame for a scalable data channel.

Referring now to FIG. 3B, there is shown a schematic diagram of an alternative frame 390 for the scalable data channel 300. Frame 390 includes the control segment 350 and audio segment 360 of frame 340. In frame 390, the control segment 350 also includes fields 392, 394, 396 in the core layer 310, first augmentation layer 320 and second augmentation layer 330 respectively.

Field 392 carries a flag that indicates the organization of augmentation data. According to a first flag value, augmentation data is organized according to a predetermined configuration. This preferably is the configuration of frame 340, so that augmentation data for left audio channel CH_L is carried in the first subsegment 370 and augmentation data for right audio channel CH_R is carried in the second subsegment 380. A configuration wherein each channel's core and augmentation data are carried in the same subsegment is referred to herein as an aligned configuration. According to a second flag value, augmentation data is distributed in the augmentation layers 320, 330 in an adaptive manner, and fields 394, 396 respectively carry an indication of where augmentation data for each respective audio channel is carried.

Field 392 preferably has sufficient size to carry an error detection code for data in the core layer portion 352 of control segment 350. It is desirable to protect this control data because it controls decoding operations of the core layer 310. Field 392 may alternatively carry an error detection code that protects the core layer portions 372, 382 of audio segment 360. No error detection need be provided for the data in augmentation layers 320, 330 because the effect of such errors will usually be at most barely audible where the width L of the core layer 310 is sufficient. For example, where the core layer 310 is perceptually coded to a sixteen bit word depth, the augmentation data primarily provides subtle detail and errors in augmentation data typically will be difficult to hear upon decode and playback.

Fields 394, 396 may each carry an error detection code. Each code provides protection for the augmentation layer 320, 330 in which it is carried. This preferably includes error detection for control data, but may alternatively include error correction for audio data, or for both control and audio data. Two different error detection codes may be specified for each augmentation layer 320, 330. A first error detection code specifies that augmentation data for the respective augmentation layer is organized according to a predetermined configuration, such as that of frame 340. A second error detection code for each layer specifies that augmentation data for the respective layer is distributed in the respective layer and that pointers are included in the control segment 350 to indicate locations of this augmentation data. Preferably the augmentation data is in the same frame 390 of the data channel 300 as corresponding data in the core layer 310. A predetermined configuration can be used to organize one augmentation layer and pointers to organize the other. The error detection codes may alternatively be error correction codes.

Figure 4A:
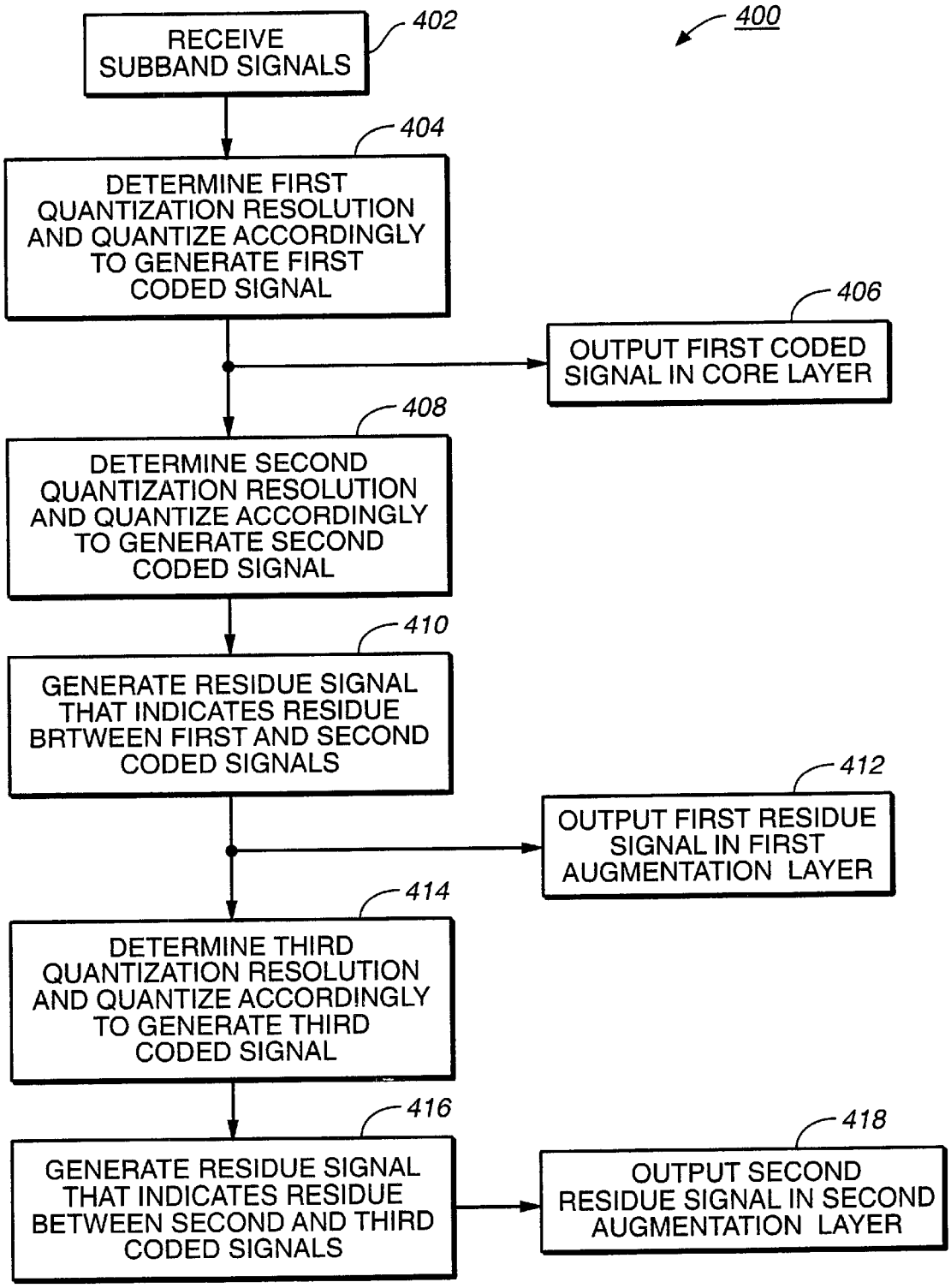
FIG. 4A is a flowchart of a scalable coding process.

Referring now to FIG. 4A there is shown a flowchart of an embodiment of a scalable coding process 400 according to the present invention. This embodiment uses the core layer 310 and first augmentation layer 320 of the data channel 300 shown in FIG. 3A. A plurality of subband signals are received 402, each comprising one or more subband signal elements. In step 404, a respective first quantization resolution for each subband signal is determined in response to a first desired noise spectrum. The first desired noise spectrum is established according to psychoacoustic principles and preferably also in response to a data capacity requirement of the core layer 310. This requirement may, for example, be the total data capacity limits of core layer portions 372, 382. Subband signals are quantized according to the respective first quantization resolution to generate a first coded signal. The first coded signal is output 406 in core layer portions 372, 382 of the audio segment 360.

In step 408, a respective second quantization resolution is determined for each subband signal. The second quantization resolution preferably is established in response to a data capacity requirement of the union of the core and first augmentation layers 310, 320 and preferably also according to psychoacoustic principles. The data capacity requirement may, for example, be a total data capacity limit of the union of core and first augmentation layer portions 372, 374. Subband signals are quantized according to the respective second quantization resolution to generate a second coded signal. A first residue signal is generated 410 that conveys some residual measure or difference between the first and second coded signals. This preferably is implemented by subtracting the first coded signal from the second coded signal in accordance with two's complement or other form of binary arithmetic. The first residue signal is output 412 in first augmentation layer portions 374, 384 of the audio segment 360.

In step 414, a respective third quantization resolution is determined for each subband signal. The third quantization resolution preferably is established according to the data capacity of the union of layers 310, 320, 330. Psychoacoustic principles preferably are used to establish the third quantization resolution as well. Subband signals are quantized according to the respective third quantization resolution to generate a third coded signal. A second residue signal is generated 416 that conveys some residual measure or difference between the second and third coded signals. The second residue signal preferably is generated by forming the two's complement (or other binary arithmetic) difference between the second and third coded signals. The second residue signal may alternatively be generated to convey a residual measure or difference between the first and third coded signals. The second residue signal is output 418 in second augmentation layer portions 376, 386 of the audio segment 360.

In steps 404, 408, 414, when a subband signal includes more than one subband signal element, the quantization of the subband signal to a particular resolution may comprise uniformly quantizing each element of the subband signal to the particular resolution. Thus if a subband signal (ss) includes three subband signal elements ($se_1$, $se_2$, $se_3$), the subband signal may be quantized according to a quantization resolution Q by uniformly quantizing each of its subband signal elements according to this quantization resolution Q. The quantized subband signal may be written as Q(ss) and the quantized subband signal elements may be written as $Q(se_1)$, $Q(se_2)$, $Q(se_3)$. Quantized subband signal Q(ss) thus comprises the collection of quantized subband signal elements ($Q(se_1)$, $Q(se_2)$, $Q(se_3)$). A coding range that identifies a range of quantization of subband signal elements that is permissible relative to a base point may be specified as a coding parameter. The base point preferably is the level of quantization that would yield injected noise substantially matching the auditory masking curve. The coding range may, for example, be between about 144 decibels of removed noise to about 48 decibels of injected noise relative to the auditory masking curve, or more briefly, −144 dB to +48 dB.

In an alternative embodiment of the present invention, subband signal elements within the same subband signal are on average quantized to a particular quantization resolution Q, but individual subband signal elements are non-uniformly quantized to different resolutions. In yet another alternative embodiment that provides non-uniform quantization within a subband, a gain-adaptive quantization technique quantizes some subband signal elements within the same subband to a particular quantization resolution Q and quantizes other subband signal elements in that subband to a different resolution that may be finer or more coarse than resolution Q by some determinable amount. A preferred method for carrying out non-uniform quantization within a respective subband is disclosed in a patent application by Davidson et al. entitled "Using Gain-Adaptive Quantization and Non-Uniform Symbol Lengths for Improved Audio Coding" filed Jul. 7, 1999, which is incorporated herein by reference.

In step 402, the received subband signals preferably include a set of left subband signals SS_L that represent left audio channel CH_L and a set of right subband signals SS_R that represent right audio channel CH_R. These audio channels may be a stereo pair or may alternatively be substantially unrelated to one another. Perceptual coding of the audio signal channels CH_L, CH_R is preferably carried out using a pair of desired noise spectra, one spectrum for each of the audio channels CH_L, CH_R. A subband signal of set SS_L may thus be quantized at different resolution than a corresponding subband signal of set SS_R. The desired noise spectrum for one audio channel may be affected by the signal content of the other channel by taking into account cross-channel masking effects. In preferred embodiments, cross-channel masking effects are ignored.

The first desired noise spectrum for the left audio channel CH_L is established in response to auditory masking characteristics of subband signals SS_L, optionally the cross-channel masking characteristics of subband signals SS_R, as well as additional criteria such as available data capacity of core layer portion 372, as follows. Left subband signals SS_L and optionally right subband signals SS_R as well are analyzed to determine an auditory masking curve AMC_L for left audio channel CH_L. The auditory masking curve indicates the maximum amount of noise that can be injected into each respective subbands of the left audio channel CH_L without becoming audible. What is audible in this respect is based on psychoacoustic models of human hearing and may involve cross-channel masking characteristics of right audio channel CH_R. Auditory masking curve AMC_L serves as an initial value for a first desired noise spectrum for left audio channel CH_L, which is analyzed to determine a respective quantization resolution Q1_L for each subband signal of set SS_L such that when the subband signals of set SS_L are quantized accordingly Q1_L(SS_L), and then dequantized and converted into sound waves, the resulting coding noise is inaudible. For clarity, it is noted that the term Q1_L refers to a set of quantization resolutions, with such set having a respective value $Q1_L_{ss}$ for each subband signal ss in the set of subband signals SS_L. It should be understood that the notation Q1_L(SS_L) means that each subband signal in the set SS_L is quantized according to a respective quantization resolution. Subband signal elements within each subband signal may be quantized uniformly or non-uniformly, as described above.

In like manner, right subband signals SS_R and preferably left subband signals SS_L as well are analyzed to generate an auditory masking curve AMC_R for right audio channel CH_R. This auditory masking curve AMC_R may serve as an initial first desired noise spectrum for right audio channel CH_R, which is analyzed to determine a respective quantization resolution Q1_R for each subband signal of set SS_R.

Figure 4B:
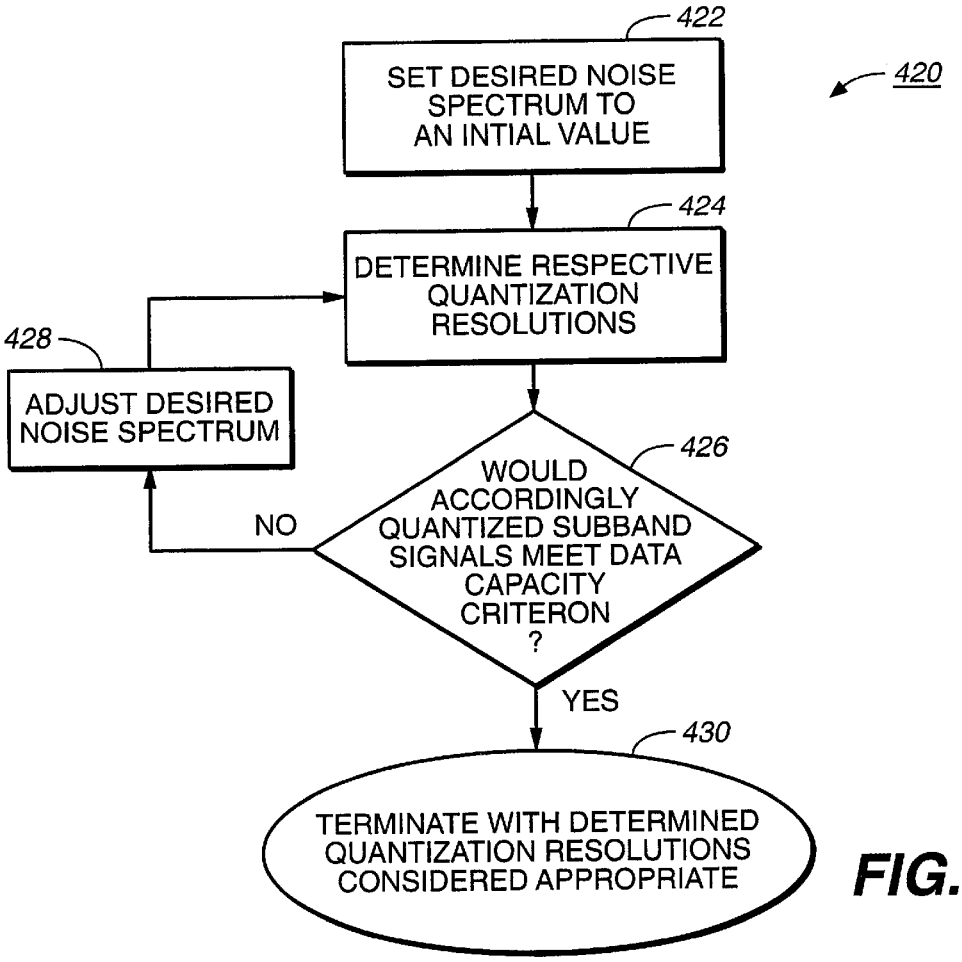
FIG. 4B is a flowchart of a process for determining appropriate quantization resolutions for the scalable coding process illustrated in FIG. 4A.

Referring now also to FIG. 4B, there is shown a flowchart of a process for determining quantization resolutions according to the present invention. Process 420 may be used, for example, to find appropriate quantization resolutions for coding each layer according to process 400. Process 420 will be described with respect to the left audio channel CH_L, the right audio channel CH_R is processed in like manner.

An initial value for a first desired noise spectrum FDNS_L is set 422 equal to the auditory masking curve AMC_L. A respective quantization resolution for each subband signal of set SS_L is determined 424 such that were these subband signals accordingly quantized, and then dequantized and converted into sound waves, any quantization noise thereby generated would be substantially match the first desired noise spectrum FDNS_L. In step 426, it is determined whether accordingly quantized subband signals would meet a data capacity requirement of the core layer 310. In this embodiment of process 420, the data capacity requirement is specified to be whether the accordingly quantized subband signals would fit in and substantially use up the data capacity of core layer portion 372. In response to a negative determination in step 426, the first desired noise spectrum FDNS_L is adjusted 428. The adjustment comprises shifting the first desired noise spectrum FDNS_L by an amount that preferably is substantially uniform across the subbands of the left audio channel CH_L. The direction of the shift is upward, which corresponds to coarser quantization, where the accordingly quantized subband signals from step 426 did not fit in core layer portion 372. The direction of the shift is downward, which corresponds to finer quantization, where the accordingly quantized subband signals from step 426 did fit in core layer portion 372. The magnitude of the first shift is preferably equal to about one-half the remaining distance to the extrema of the coding range in the direction of the shift. Thus, where the coding range is specified as −144 dB to +48 dB, the first such shift may, for example, comprise shifting the FDNS_L upward by about 24 dB. The magnitude of each subsequent shift is preferably about one-half the magnitude of the immediately prior shift. Once the first desired noise spectrum FDNS_L is adjusted 428, steps 424 and 426 are repeated. When a positive determination is made in a performance of step 426, the process terminates 430 and the determined quantization resolutions Q1_L are considered to be appropriate.

The subband signals of set SS_L are quantized at the determined quantization resolutions Q1_L to generate quantized subband signals Q1_L(SS_L). The quantized subband signals Q1_L(SS_L) serve as a first coded signal FCS_L for the left audio channel CH_L. The quantized subband signals Q1_L(SS_L) can be conveniently output in core layer portion 372 in any pre-established order, such as by increasing spectral frequency of subband signal elements. Allocation of the data capacity of core layer portion 372 among quantized subband signals Q1_L(SS_L) is thus based on hiding as much quantization noise as practicable given the data capacity of this portion of the core layer 310. Subband signals SS_R for the right audio channel CH_R processed in similar manner to generate a first coded signal FCS_R for that channel CH_R, which is output in core layer portion 382.

Appropriate quantization resolutions Q2_L for coding first augmentation layer portion 374 are determined according to process 420 as follows. An initial value for a second desired noise spectrum SDNS_L for the left audio channel CH_L is set 422 equal to the first desired noise spectrum FDNS_L. The second desired noise spectrum SDNS_L is analyzed to determine a respective second quantization resolution $Q2_L_{ss}$ for each subband signal ss of set SS_L such that were subband signals of set SS_L quantized according to Q2_L(SS_L), and then dequantized and converted to sound waves, the resulting quantization noise would substantially match the second desired noise spectrum SDNS_L. In step 426, it is determined whether accordingly quantized subband signals would meet a data capacity requirement of the first augmentation layer 320. In this embodiment of process 420, the data capacity requirement is specified to be whether a residue signal would fit in and substantially use up the data capacity of first augmentation layer portion 374. The residue signal is specified as a residual measure or difference between the accordingly quantized subband signals Q2_L(SS_L) and the quantized subband signals Q1_L(SS_L) determined for core layer portion 372.

In response to a negative determination in step 426, the second desired noise spectrum SDNS_L is adjusted 428. The adjustment comprises shifting the second desired noise spectrum SDNS_L by an amount that preferably is substantially uniform across the subbands of the left audio channel CH_L. The direction of the shift is upward where the residue signals from step 426 did not fit in the first augmentation layer portion 374, and otherwise it is downward. The magnitude of the first shift is preferably equal to about one-half the remaining distance to the extrema of the coding range in the direction of the shift. The magnitude of each subsequent shift is preferably about one-half the magnitude of the immediately prior shift. Once the second desired noise spectrum SDNS_L is adjusted 428, steps 424 and 426 are repeated. When a positive determination is made in a performance of step 426, the process terminates 430 and the 25 determined quantization resolutions Q2_L are considered to be appropriate.

The subband signals of set SS_L are quantized at the determined quantization resolutions Q2_L to generate respective quantized subband signals Q2_L(SS_L) which serve as a second coded signal SCS_L for the left audio channel CH_L. A corresponding first residue signal FRS_L for the left audio channel CH_L is generated. A preferred method is to form a residue for each subband signal element and output bit representations for such residues by concatenation in a pre-established order, such as according to increasing frequency of subband signal elements, in first augmentation layer portion 374. Allocation of the data capacity of first augmentation layer portion 374 among quantized subband signals Q2_L(SS_L) is thus based on hiding as much quantization noise as practicable given the data capacity of this portion 374 of the first augmentation layer 320. Subband signals SS_R for the right audio channel CH_R are processed in similar manner to generate a second coded signal SCS_R and first residue signal FRS_R for that channel CH_R. The first residue signal FRS_R for the right audio channel CH_R is output in first augmentation layer portion 384.

The quantized subband signals Q2_L(SS_L) and Q1_L (SS_L) can be determined in parallel. This is preferably implemented by setting the initial value of the second desired noise spectrum SDNS_L for the left audio channel CH_L equal to the auditory masking curve AMC_L or other specification that does not depend on the first desired noise spectrum FDNS_L determined for coding the core layer. The data capacity requirement is specified as being whether the accordingly quantized subband signals Q2_L (SS_L) would fit in and substantially use up the union of core layer portion 372 with the first augmentation layer portion 374.

An initial value for the third desired noise spectrum for audio channel CH_L is obtained, and process 420 applied to obtain respective third quantization resolutions Q3_L as is done for the second desired noise spectrum. Accordingly quantized subband signals Q3_L(SS_L) serve as a third coded signal TCS_L for the left audio channel CH_L. A second residue signal SRS_L for the left audio channel CH_L may then be generated in a manner that is similar to that done for the first augmentation layer. In this case, however, residue signals are obtained by subtracting subband signal elements in the third coded signal TCS_L from corresponding subband signal elements in second coded signal SCS_L. The second residue signal SRS_L is output in second augmentation layer portion 376. Subband signals SS_R for the right audio channel CH_R are processed in similar manner to generate a third coded signal TCS_R and second residue signal SRS_R for that channel CH_R. The second residue signal SRS_R for the right audio channel CH_R is output in second augmentation layer portion 386.

Control data is generated for core layer portion 352. In general, the control data allows decoders to synchronize with each frame in a coded stream of frames, and indicates to decoders how to parse and decode the data supplied in each frame such as frame 340. Because a plurality of coded resolutions are provided, the control data typically is more complex than that found in non-scalable coding implementations. In a preferred embodiment of the present invention, control data includes a synchronization pattern, format data, segment data, parameter data, and an error detection code, all of which are discussed below. Additional control information is generated for the augmentation layers 320, 330 that specifies how these layers 320, 330 can be decoded.

A predetermined synchronization word may be generated to indicate the beginning of a frame. The synchronization pattern is output in the first L bits of the first word of each frame to indicate where the frame begins. The synchronization pattern preferably does not occur at any other location in the frame. Synchronization patterns indicate to decoders how to parse frames from a coded data stream.

Format data may be generated that indicates program configuration, bitstream profile, and frame rate. Program configuration indicates the number and distribution of channels included in the coded bitstream. Bitstream profile indicates what layers of the frame are utilized. A first value of bitstream profile indicates that coding is supplied in only the core layer 310. The augmentation layers 320, 330 preferably are omitted in this instance to save data capacity on the data channel. A second value of bitstream profile indicates that coded data is supplied in core layer 310 and in first augmentation layer 320. The second augmentation layer 330 preferably is omitted in this instance. A third value of bitstream profile indicates that coded data is supplied in each layer 310, 320, 330. The first, second, and third values of bitstream profile preferably are determined in accordance with the AES3 specification. The frame rate may be determined as a number, or approximate number, of frames per unit time, such as 30 Hertz, which for standard AES3 corresponds to about one frame per 3,200 words. The frame rate helps decoders to maintain synchronization and effective buffering of incoming coded data.

Segment data is generated that indicates boundaries of segments and subsegments. These include indicating boundaries of control segment 350, audio segment 360, first subsegment 370, and second subsegment 380. In alternative embodiments of scalable coding process 400, additional subsegments are included in a frame, for example, for multi-channel audio. Additional audio segments can also be provided to reduce the average volume of control data in frames by combining audio information from a plurality of frames into a larger frame. A subsegment may also be omitted, for example, for audio applications requiring fewer audio channels. Data regarding boundaries of additional subsegments or omitted subsegments can be provided as segment data. The depths L, M, N respectively of the layers 310, 320, 330 can also be specified in similar manner. Preferably, L is specified as sixteen to support backward compatibility with conventional 16 bit digital signal processors. Preferably, M and N are specified as four and four to support scalable data channel criteria specified by standard AES3. Specified depths preferably are not explicitly carried as data in a frame but are presumed at coding to be appropriately implemented in decoding architectures.

Parameter data is generated that indicates parameters of coding operations. Such parameters indicate which species of coding operation is used for coding data into a frame. A first value of parameter data may indicate that core layer 310 is coded according to the public ATSC AC-3 bitstream specification as specified in the Advanced Television Standards Committee (ATSC) A52 document (1994). A second value of parameter data may indicate that the core layer 310 is coded according to a perceptual coding technique embodied in Dolby Digital® coders and decoders. Dolby Digital® coders and decoders are commercially available from Dolby Laboratories, Inc. of San Francisco, Calif. The present invention may be used with a wide variety of perceptual coding and decoding techniques. Various aspects of such perceptual coding and decoding techniques are disclosed in U.S. Pat. No. 5,913,191 (Fielder), U.S. Pat. No. 5,222,189 (Fielder), U.S. Pat. No. 5,109,417 (Fielder, et al.), U.S. Pat. No. 5,632,003 (Davidson, et al.), U.S. Pat. No. 5,583,962 (Davis, et al.), and U.S. Pat. No. 5,623,577 (Fielder), and in U.S. patent application Ser. No. 09/289,865 by Ubale, et al., each of which is incorporated by reference in its entirety. No particular perceptual coding or decoding technique is essential for practicing the present invention.

One or more error detection codes are generated for protecting data in core layer portion 352 and, if data capacity allows, data in the core layer portions 372, 382 of core layer 310. Core layer portion 352 preferably is protected to a greater degree than any other portion of frame 340 because it includes all essential information for synchronizing to frames 340 in a coded data stream and for parsing the core layer 310 of each frame 340.

In this embodiment of the present invention, data is output into a frame as follows. First coded signals FCS_L, FCS_R are output respectively in core layer portions 372, 382, first residue signals FRS_L, FRS_R are output respectively in first augmentation layer portions 374, 384, and second residue signals SRS_L, SRS_R are output respectively in second augmentation layer portions 376, 386. This may be achieved by multiplexing these signals FCS_L, FCS_R, FRS_L, FRS_R, SRS_L, SRS_R together to form a stream of words each of length L+M+N, with, for example, signal FCS_L carried by the first L bits, FRS_L carried by the next M bits and SRS_L carried by final N bits, and similarly for signals FCS_R, FRS_R, SRS_R. This stream of words is output serially in the audio segment 360. The synchronization word, format data, segment data, parameter data, and data protection information are output in core layer portion 352. Additional control information for augmentation layers 320, 330 is supplied to their respective layers 320, 330.

According to preferred embodiments of scalable audio coding process 400, each subband signal in the core layer is represented in a block-scaled form comprising a scale factor and one or more scaled values representing each subband signal element. For example, each subband signal may be represented in a block-floating point in which a block-floating-point exponent is the scale factor and each subband signal element is represented by the floating-point mantissas. Essentially any form of scaling may be used. To facilitate parsing the coded data stream to recover the scale factors and scaled values, the scale factors may be coded into the data stream at pre-established positions within each frame such as at the beginning of each subsegment 370, 380 within audio segment 360.

In preferred embodiments, the scale factors provide a measure of subband signal power that can be used by a psychoacoustic model to determine the auditory masking curves AMC_L, AMC_R discussed above. Preferably, scale factors for the core layer 310 are used as scale factors for the augmentation layers 320, 330, and it is thus not necessary to generate and output a distinct set of scale factors for each layer. Only the most significant bits of the differences between corresponding subband signal elements of the various coded signals typically are coded into the augmentation layers.

In preferred embodiments, additional processing is performed to eliminate reserved or forbidden data patterns from the coded data. For example, data patterns in the encoded audio data that would mimic a synchronization pattern reserved to appear at the start of a frame should be avoided. One simple way in which a particular non-zero data pattern may be avoided is to modify the encoded audio data by performing a bit-wise exclusive OR between the encoded audio data and a suitable key. Further details and additional techniques for avoiding forbidden and reserved data patterns are disclosed in U.S. Pat. No. 6,233,718 entitled "Avoiding Forbidden Data Patterns in Coded Audio Data" by Vernon, et al. A key or other control information may be included in each frame to reverse the effects of any modifications performed to eliminate these patterns.

Figure 5:
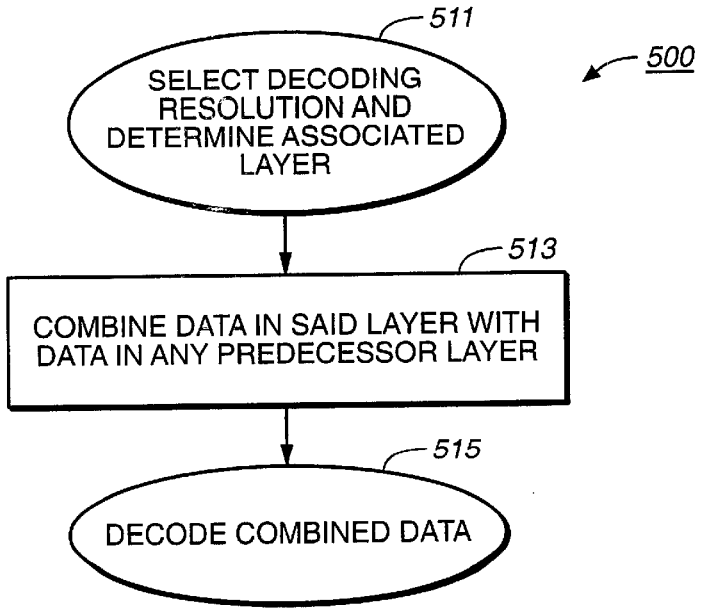
FIG. 5 is a flowchart illustrating a scalable decoding process.

Referring now to FIG. 5, there is shown a flowchart illustrating a scalable decoding process 500 according to the present invention. Scalable decoding process 500 receives an audio signal coded into a series of layers. The first layer includes a perceptual coding of the audio signal. This perceptual coding represents the audio signal with a first resolution. Remaining layers each include data about another respective coding of the audio signal. The layers are ordered according to increasing resolution of coded audio. More particularly, data from the first K layers may be combined and decoded to provide audio with greater resolution than data in the first K−1 layers, where K is an integer greater than one and not greater than the number total number of layers.

According to process 500 a resolution for decoding is selected 511. The layer associated with the selected resolution is determined. If the data stream was modified to remove reserved or forbidden data patterns, the effects of the modifications should be reversed. Data carried in the determined layer is combined 513 with data in each predecessor layer and then decoded 515 according to an inverse operation of the coding process employed to code the audio signal to the respective resolution. Layers associated with resolutions higher than that selected can be stripped off or ignored, for example, by signal routing circuitry. Any process or operation that is required to reverse the effects of scaling should be performed prior to decoding.

An embodiment is now described where scalable decoding process 500 is performed by processing system 100 on audio data received via a standard AES3 data channel. The standard AES3 data channel provides data in a series of twenty-four bit wide words. Each bit of a word may conveniently be identified by a bit number ranging from zero (0), which is the most significant bit, through twenty-three (23), which is the least significant bit. The notation bits (n~m) is used herein to represent bits (n) through (m) of a word, where n and m are integers and m>n. The AES3 data channel is partitioned into a series of frames such as frame 340 in accordance with scalable data channel 300 of the present invention. Core layer 310 comprises bits (0~15), first augmentation layer 320 comprises bits (16~19), and second augmentation layer 330 comprises bits (20~23).

Data in layers 310, 320, 330 is received via audio input/output interface 140 of processing system 100. Responsive to the program of decoding instructions, processing system 100 searches for a sixteen-bit synchronization pattern in the data stream to align its processing with each frame boundary, partitions the data serially beginning with the synchronization pattern into twenty-four bit wide words represented as bits(0~23). Bits (0~15) of the first word are thus the synchronization pattern. Any processing required to reverse the effects of modifications made to avoid reserved patterns can be performed at this time.

Pre-established locations in core layer 310 are read to obtain format data, segment data, parameter data, offsets, and data protection information. Error detection codes are processed to detect any error in the data in core layer portion 352. Muting of corresponding audio or retransmission of data may be performed in response to detection of a data error. Frame 340 is then parsed to obtain data for subsequent decoding operations.

To decode just the core layer 310, the sixteen bit resolution is selected 511. Established locations in core layer portions 372, 382 of first and second audio subsegments 370, 380 are read to obtain the coded subband signal elements. In preferred embodiments using block-scaled representations, this is accomplished by first obtaining the block scaling factor for each subband signal and using these scale factors to generate the same auditory masking curves AMC_L, AMC_R that were used in the encoding process. First desired noise spectrums for audio channels CH_L, CH_R are generated by shifting the auditory masking curves AMC_L, AMC_R by respective offsets O1_L, O1_R for each channel read from core layer portion 352. First quantization resolutions Q1_L, Q1_R are then determined for the audio channels in the same manner used by coding process 400. Processing system 100 can now determine the length and location of the coded scaled values in core layer portions 372, 382 of audio subsegments 370, 380, respectively, that represent the scaled values of the subband signal elements. The coded scaled values are parsed from subsegments 370, 380 and combined with the corresponding subband scale factors to obtain the quantized subband signal elements for audio channels CH_L, CH_R, which are then converted into digital audio streams. The conversion is performed by applying a synthesis filter bank complementary to the analysis filter bank applied during the encode process. The digital audio streams represent the left and right audio channels CH_L, CH_R. These digital signals may be converted into an analog signal by digital-to-analog conversion, which beneficially can be implemented in conventional manner.

The core and first augmentation layers 310, 320 can be decoded as follows. The 20 bit coding resolution is selected 511. Subband signal elements in the core layer 310 are obtained as just described. Additional offsets O2_L are read from augmentation layer portion 354 of control segment 350. Second desired noise spectrums for audio channels CH_L are generated by shifting the first desired noise spectrum of left audio channel CH_L by the offset O2_L and responsive to the obtained noise spectrum, second quantization resolutions Q2_L are determined in the manner described for perceptually coding the first augmentation layer according to coding process 400. These quantization resolutions Q2_L indicate the length and location of each component of residue signal RES1_L in augmentation layer portion 374. Processing system 100 reads the respective residue signals and obtains the scaled representation of the quantized subband signal elements by combining 513 the residue signal RES 1_L with the scaled representation obtained from core layer 310. In this embodiment of the present invention, this is achieved using two's complement addition, where this addition is performed on a subband signal element by subband signal element basis. The quantized subband signal elements are obtained from the scaled representations of each subband signal and are then converted by an appropriate signal synthesis process to generate a digital audio stream for each channel. The digital audio stream may be converted to analog signals by digital-to-analog conversion. The core and first and second augmentation layers 310, 320, 330 can be decoded in a manner similar to that just described.

Figure 6A:
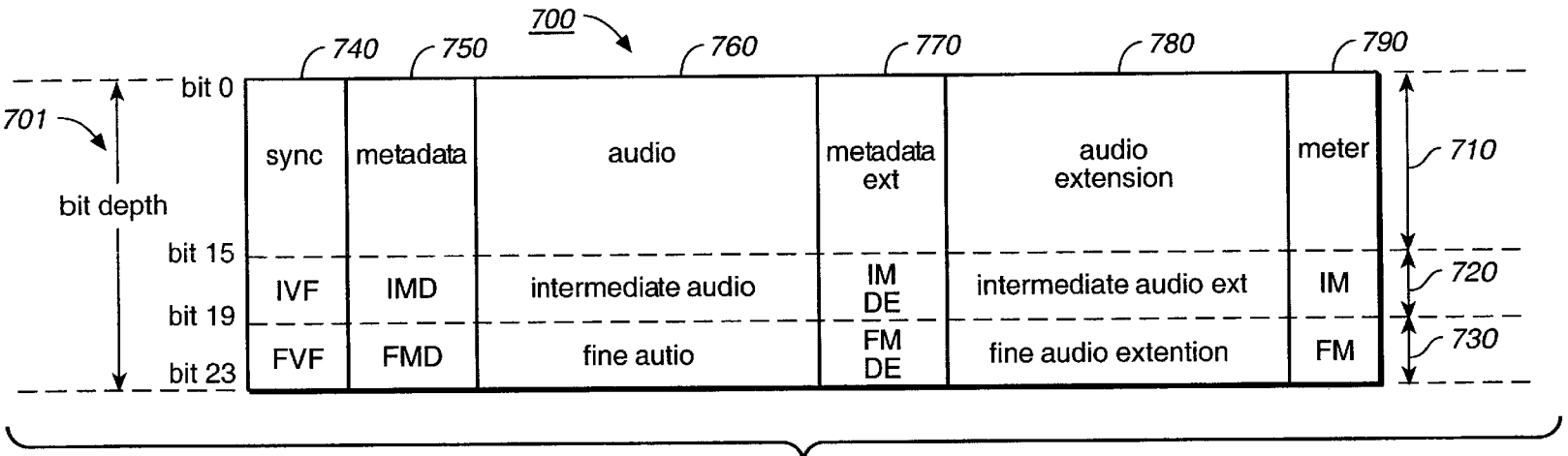
FIG. 6A is a schematic diagram of a frame for a scalable data channel.

Referring now to FIG. 6A, there is shown a schematic diagram of an alternative embodiment of a frame 700 for scalable audio coding according to the present invention. Frame 700 defines the allocation of data capacity for a twenty-four bit wide AES3 data channel 701. The AES3 data channel comprises a series of twenty-four bit wide words. The AES3 data channel includes a core layer 710 and two augmentation layers identified as an intermediate layer 720, and a fine layer 730. The core layer 710 comprises bits (0~15), the intermediate layer 720 comprises bits (16~19), and the fine layer 730 comprises bits (20~23), respectively, of each word. The fine layer 730 thus comprises the four least significant bits of the AES3 data channel, and the intermediate layer 720 the next four least significant bits of that data channel.

Data capacity of the data channel 701 is allocated to support decoding of audio at a plurality of resolutions. These resolutions are referred to herein as a sixteen bit resolution supported by the core layer 710, a twenty bit resolution supported by the union of the core layer 710 and intermediate layer 720, and a twenty-four bit resolution supported by the union of the three layers 710, 720, 730. It should be understood that the number of bits in each resolution mentioned above refers to the capacity of each respective layer during transmission or storage and does not refer to the quantization resolution or bit length of the symbols carried in the various layers to represent encoded audio signals. As a result, the so called "sixteen bit resolution" corresponds to perceptual coding at a basic resolution and typically is perceived upon decode and playback to be more accurate than sixteen bit PCM audio signals. Similarly, the twenty and twenty-four bit resolutions correspond to perceptual codings at progressively higher resolutions and typically are perceived to be more accurate than corresponding twenty and twenty-four bit PCM audio signals, respectively.

Figure 6B:
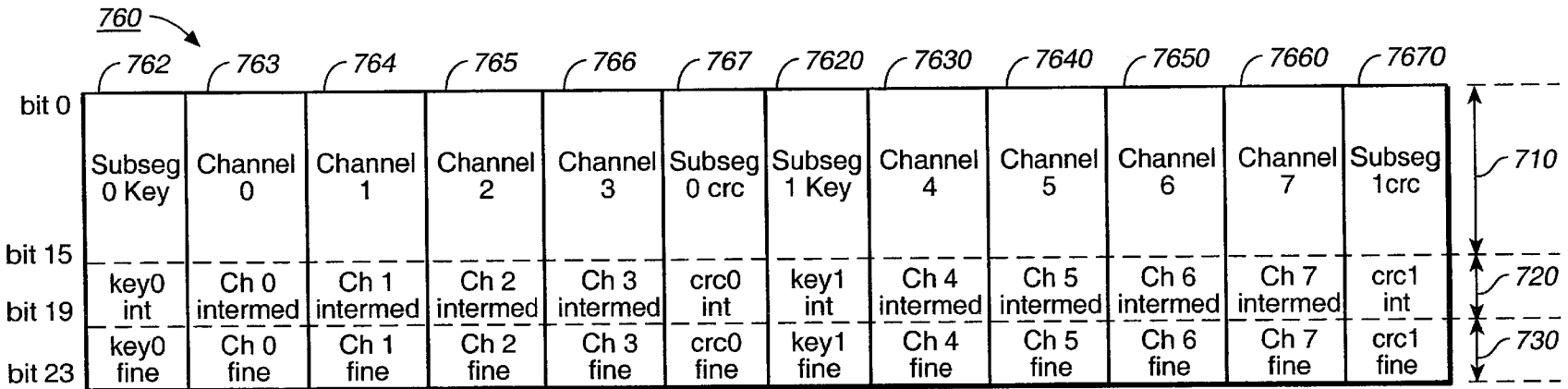
FIG. 6B is a schematic diagram of preferred structure for the audio segment and audio extension segments illustrated in FIG. 6A.
Figure 6C:
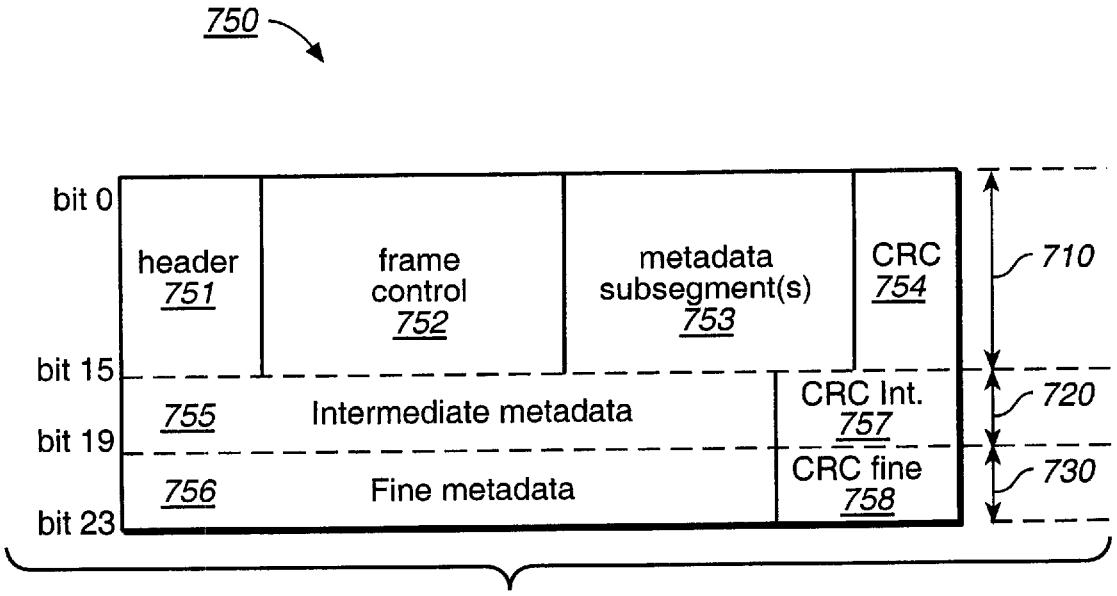
FIG. 6C is a schematic diagram of preferred structure for the metadata segment illustrated in FIG. 6A.
Figure 6D:
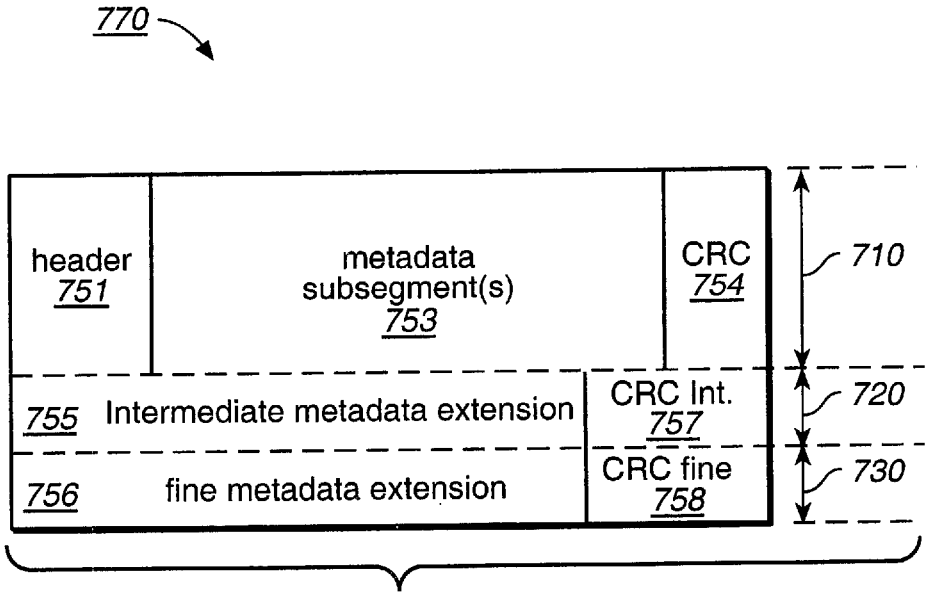
FIG. 6D is a schematic diagram of preferred structure for the metadata extension segment illustrated in FIG. 6A.

Frame 700 is divided into a series of segments that include a synchronization segment 740, metadata segment 750, audio segment 760, and may optionally include a metadata extension segment 770, audio extension segment 780, and a meter segment 790. The metadata extension segment 770 and audio extension segment 780 are dependent on one another, and accordingly, either both are included or neither is included. In this embodiment of frame 700, each segment includes portions in each layer 710, 720, 730. Referring now also to FIGS. 6B, 6C, and 6D there are shown schematic diagrams of preferred structure for the audio and audio extension segments 760 and 780, the metadata segment 750, and the metadata extension segment 770.

In the synchronization segment 740, bits (0~15) carry a sixteen bit synchronization pattern, bits (16~19) carry one or more error detection codes for the intermediate layer 720, and bits (20~23) carry one or more error detection codes for the fine layer 730. Errors in augmentation data typically yield subtle audible effects, and accordingly data protection is beneficially limited to codes of four bits per augmentation layer to save data in the AES3 data channel. Additional data protection for augmentation layers 720, 730 may be provided in the metadata segment 750 and metadata extension segment 770 as discussed below. Optionally, two different data protection values may be specified for each respective augmentation layer 720, 730. Either provides data protection for the respective layer 720, 730. The first value of data protection indicates that the respective layer of the audio segment 760 is configured in a predetermined manner such as aligned configuration. The second value of data protection indicates that pointers carried by the metadata segment 750 indicate where augmentation data is carried in the respective layer of the audio segment 760, and if the audio extension segment 780 is included, that pointers in the metadata extension segment 770 indicate where augmentation data is carried in the respective layer of the audio extension segment 780.

Audio segment 760 is substantially similar to the audio segment 360 of frame 390 described above. Audio segment 760 includes first subsegment 761 and second subsegment 7610. The first subsegment 761 includes a data protection segment 767, four respective channel subsegments (CS_0, CS_1, CS_2, CS_3) each comprising a respective subsegment 763, 764, 765, 766 of first subsegment 761, and may optionally include a prefix 762. The channel subsegments correspond to four respective audio channels (CH_0, CH_1, CH_2, CH_3) of a multi-channel audio signal.

In optional prefix 762, the core layer 710 carries a forbidden pattern key (KEY1_C) for avoiding forbidden patterns within that portion of the first subsegment carried respectively by core layer 710, the intermediate layer 720 carries a forbidden pattern key (KEY1_I) for avoiding forbidden patterns within that portion of the first subsegment carried by intermediate layer 720, and the fine layer 730 carries a forbidden pattern key (KEY1_F) for avoiding forbidden patterns within that portion of the first subsegment carried respectively by fine layer 730.

In channel subsegment CS_0, the core layer 710 carries a first coded signal for audio channel CH_0, the intermediate layer 720 carries a first residue signal for the audio channel CH_0, and the fine layer 730 carries a second residue signal for audio channel CH_0. These preferably are coded into each corresponding layer using the coding process 400 modified as discussed below. Channel segments CS_1, CS_2, CS_3 carry data respectively for audio channels CH_1, CH_2, CH_3 in like manner.

In data protection segment 767, the core layer 710 carries one or more error detection codes for that portion of the first subsegment carried respectively by core layer 710, the intermediate layer 720 carries one or more error detection codes for that portion of the first subsegment carried by intermediate layer 720, and the fine layer 730 carries one or more error detection codes for that portion of the first subsegment carried respectively by fine layer 730. Data protection preferably is provided by a cyclic redundancy code (CRC) in this embodiment.

The second subsegment 7610 includes in like manner a data protection segment 7670, four channel subsegments (CH_4, CH_5, CH_6, CH_7) each comprising a respective subsegment 7630, 7640, 7650, 7660 of second subsegment 7610, and may optionally include a prefix 7620. The second subsegment 7610 is configured in a similar manner as the subsegment 761. The audio extension segment 780 is configured like the audio segment 760 and allows for two or more segments of audio within a single frame, and may thereby reduce expended data capacity in the standard AES3 data channel.

The metadata segment 750 is configured as follows. That portion of metadata segment 750 carried by core layer 710 includes a header segment 751, a frame control segment 752, a metadata subsegment 753, and a data protection subsegment 754. That portion of metadata segment 750 carried by the intermediate layer 720 includes an intermediate metadata subsegment 755 and a data protection subsegment 757, and that portion of metadata segment 750 carried by the fine layer 730 includes a fine metadata subsegment 756 and a data protection subsegment 758. The data protection subsegments 754, 757, 758 need not be aligned between layers, but each preferably is located at the end of its respective layer or at some other predetermined location.

Header 751 carries format data that indicates program configuration and frame rate. Frame control segment 752 carries segment data that specifies boundaries of segments and subsegments in the synchronization, metadata, and audio segments 740, 750, 760. Metadata subsegments 753, 755, 756 carry parameter data that indicates parameters of encoding operations performed for coding audio data into the core, intermediate, and fine layers 710, 720, 730 respectively. These indicate which type of coding operation is used to code the respective layer. Preferably the same type of coding operation is used for each layer with the resolution adjusted to reflect relative amounts of data capacity in the layers. It is alternatively permissible to carry parameter data for intermediate and fine layers 720, 730 in the core layer 720. However all parameter data for the core layer 710 preferably is included only in the core layer 710 so that augmentation layers 720, 730 can be stripped off or ignored, for example by signal routing circuitry, without affecting the ability to decode the core layer 710. Data protection subsegments 754, 757, 758 carry one or more error detection codes for protecting the core, intermediate, and fine layers 710, 720, 730 respectively.

The metadata extension segment 770 is substantially similar to the metadata segment 750 except that the metadata extension segment 770 does not include a frame control segment 752. The boundaries of segments and subsegments in the metadata extension and audio extension segments 770, 780 is indicated by their substantial similarity to the metadata and audio segments 750, 760 in combination with the segment data carried by the frame control segment 752 in the metadata segment 750.

Optional meter segment 790 carries average amplitudes of coded audio data carried in frame 700. In particular, where the audio extension segment 780 is omitted, bits (0~15) of meter segment 790 carry a representation of an average amplitude of coded audio data carried in bits (0~15) of audio segment 760, and bits (16~19) and (20~23) respectively carry extension data designated as intermediate meter (IM) and fine meter (FM) respectively. The IM may be an average amplitude of coded audio data carried in bits (16~19) of audio segment 760, and the FM may be an average amplitude of coded audio data carried in bits (20~23) of audio segment 760, for example. Where the audio extension segment 780 is included, average amplitudes, IM, and FM preferably reflect the coded audio carried in respective layers of that segment 780. The meter segment 790 supports convenient display of average audio amplitude at decode. This typically is not essential to proper decoding of audio and may be omitted, for example, to save data capacity on the AES3 data channel.

Coding of audio data into frame 700 preferably is implemented using scalable coding processes 400 and 420 modified as follows. Audio subband signals for each of the eight channels are received. These subband signals preferably are generated by applying a block transform to blocks of samples for eight corresponding channels of time-domain audio data and grouping the transform coefficients to form the subband signals. The subband signals are each represented in block-floating-point form comprising a block exponent and a mantissa for each coefficient in the subband.

The dynamic range of the subband exponents of a given bit length may be expanded by using a "master exponent" for a group of subbands. Exponents for subband in the group are compared to some threshold to determine the value of the associated master exponent. If each subband exponent in the group is greater than a threshold of three, for example, the value of the master exponent is set to one and the associated subband exponents are reduce by three, otherwise the master exponent is set to zero.

The gain-adaptive quantization technique discussed briefly above may also be used. In one embodiment, mantissas for each subband signal are assigned to two groups according whether they are greater than one-half in magnitude. Mantissas less than or equal to one half are doubled in value to reduce the number of bits needed to represent them. Quantization of the mantissas is adjusted to reflect this doubling. Mantissas can alternatively be assigned to more than two groups. For example, mantissas may be assigned to three groups depending on whether their magnitudes are between 0 and ¼, ¼ and ½, ½ and 1, scaled respectively by 4, 2, and 1, and quantized accordingly to save additional data capacity. Additional information may be obtained from the U.S. patent application cited above.

Auditory masking curves are generated for each channel. Each auditory masking curve may be dependent on audio data of multiple channels (up to eight in this implementation) and not just one or two channels. Scalable coding process 400 is applied to each channel using these auditory masking curves, and with the modifications to quantization of mantissas discussed above. The iterative process 420 is applied to determine appropriate quantization resolutions for coding each layer. In this embodiment, a coding range is specified as about −144 dB to about +48 dB relative to the corresponding auditory masking curve. The resulting first coded, and first and second residue signal for each channel generated by processes 400 and 420 are then analyzed to determine forbidden pattern keys KEY1_C, KEY1_I, KEY1_F for the first subsegment 761 (and similarly for the second subsegment 7610) of the audio segment 760.

Control data for the metadata segment 750 is generated for the first block of multi-channel audio. Control data for the metadata extension segment 770 is generated for a second block of the multi-channel audio in similar manner, except that segment information for the second block is omitted. These are respectively modified by respective forbidden pattern keys as discussed above and output in the metadata segment 750 and metadata extension segment 770, respectively.

The above described process is also performed on a second block of the eight audio channels, and with generated coded signals output in similar manner in the audio extension segment 780. Control data is generated for the second block of multi-channel audio in essentially the same manner as for the first such block except that no segment data is generated for the second block. This control data is output in the metadata extension segment 770.

A synchronization pattern is output in bits (0~15) of the synchronization segment 740. Two four bit wide error detection codes are generated respectively for the intermediate and fine layers 720, 730 and output respectively in bits (16~19) and bits (20~23) of the synchronization segment 740. In this embodiment, errors in augmentation data typically yield subtle audible effects, and accordingly, error detection is beneficially limited to codes of four bits per augmentation layer to save data capacity in the standard AES3 data channel.

According to the present invention, the error detection codes can have predetermined values, such as "0001", that do not depend on the bit pattern of the data protected. Error detection is provided by inspecting such error detection code to determine whether the code itself has been corrupted. If so, it is presumed that other data in the layer is corrupt, and another copy of the data is obtained, or alternatively, the error is muted. A preferred embodiment specifies multiple predetermined error detection codes for each augmentation layer. These codes also indicate the layer's configuration. A first error detection code, "0101" for example, indicates that the layer has a predetermined configuration, such as aligned configuration. A second error detection code, "1001" for example, indicates that the layer has a distributed configuration, and that pointers or other data are output in the metadata segment 750 or other location to indicate the distribution pattern of data in the layer. There is little possibility that one code could be corrupted during transmission to yield the other, because two bits of the code must be corrupted without corrupting the remaining bits. The embodiment is thus substantially immune to single bit transmission errors. Moreover, any error in decoding augmentation layers typically yield at most a subtle audible effect.

In an alternative embodiment of the present invention, other forms of entropy coding are applied to compression of audio data. For example, in one alternative embodiment a sixteen bit entropy coding process generates compressed audio data that is output on a core layer. This is repeated for the data coding at higher resolution to generate a trial coded signal. The trial coded signal is combined with the compressed audio data to generate a trial residue signal. This is repeated as necessary until the trial residue signal efficiently utilizes the data capacity of a first augmentation layer, and the trial residue signal is output on a first augmentation layer. This is repeated for a second layer or multiple additional augmentation layers by again increasing the resolution of the entropy coding.

Upon reviewing the application, various modifications and variations of the present invention will be apparent to those skilled in the art. Such modifications and variations are provided for by the present invention, which is limited only by the following claims.

What is claimed is:

1. A scalable coding process, the process using a standard data channel that has a core layer and an augmentation layer, the process comprising:

receiving a plurality of subband signals;

determining a respective first quantization resolution for each subband signal in response to a first desired noise spectrum and quantizing each subband signal according to the respective first quantization resolution to generate a first coded signal;

determining a respective second quantization resolution for each subband signal in response to a second desired noise spectrum and quantizing each subband signal according to the respective second quantization resolution to generate a second coded signal;

generating a residue signal that indicates a residue between the first and second coded signals; and outputting the first coded signal in the core layer and the residue signal in the augmentation layer.

2. The process of claim 1, wherein the first desired noise spectrum is established in response to auditory masking characteristics of the subband signals determined according to psychoacoustic principles.

3. The process of claim 1, wherein the first quantization resolutions are determined responsive to subband signals quantized according to such first quantization resolutions meeting a data capacity requirement of the core layer.

4. The process of claim 1, wherein the first coded signal and residue signal are output in aligned configuration.

5. The process of claim 1, wherein additional data is output to indicate a configuration pattern of the residue signal with respect to the first coded signal.

6. The process of claim 1, wherein the second desired noise spectrum is offset from the first desired noise spectrum by a substantially uniform amount, and wherein an indication of the substantially uniform amount is output in the standard data channel.

7. The process of claim 1, wherein the first coded signal comprises a plurality of scale factors, and wherein the residue signal is represented by the scale factors of the first coded signal.

8. The process of claim 1, wherein a subband signal quantized to respective second quantization resolution is represented by a scaled value comprising a sequence of bits, and wherein the subband signal quantized to respective first quantization resolution is represented by another scaled value comprising a subsequence of said bits.

9. A scalable coding process, the process using a standard data channel that has a plurality of layers, the process comprising:

receiving a plurality of subband signals;

generating a perceptual coding and a second coding of the subband signals;

generating a residue signal that indicates a residue of the second coding relative to the perceptual coding; and outputting the perceptual coding in a first layer and the residue signal in a second layer.

10. The scalable coding process of claim 9, further comprising:

generating a third coding of the subband signals;

generating a second residue signal that indicates a residue of the third coding relative to at least one of the perceptual and second codings; and outputting the second residue signal in a third layer.

11. The scalable coding process of claim 9, wherein the data channel conforms to standard AES3 of the Audio Engineering Society, the first layer is a 16 bit wide layer of the data channel, and the second and third layers are each a 4 bit wide layer of the data channel.

12. The process claim 9, further comprising:

generating error detection data that indicates configuration of the residue signal with respect to the perceptual coding; and outputting the error detection data in the standard data channel.

13. The process claim 9, further comprising:

generating a sequence of bits;

outputting the sequence of bits in the standard data channel;

receiving a sequence of bits corresponding to the output sequence of bits at a receiver;

analyzing the received sequence of bits to determine whether it matches the generated sequence of bits; and determining in response to the analysis whether one of the perceptual coding and the residue signal includes a transmission error.

14. The process of claim 9, wherein the second coding is generated responsive to data capacity of the union of the first and second layers.

15. A method of processing data carried by a multi-layer data channel, wherein a first layer of the data channel carries a perceptual coding of an audio signal and a second layer of the data channel carries augmentation data for increasing the resolution of the perceptual coding of the audio signal, the method using a decoder and comprising:

receiving the perceptual coding and augmentation data via the data channel; and routing the perceptual coding of the audio signal to the decoder.

16. The method of claim 15, further comprising decoding the perceptual coding of the audio signal.

17. The method of claim 15, further comprising:

combining the perceptual coding with the augmentation data to generate a second coding of the audio signal having higher resolution than the perceptual coding of the audio signal; and decoding the second coding of the audio signal.

18. The method of claim 17, wherein the perceptual coding is received along a core sixteen bit layer of a data channel conforming to standard AES3 of the Audio Engineering Society, and wherein the augmentation data is received along at least one four bit wide augmentation layer of the data channel.

19. The method of claim 15, wherein combining the perceptual coding with the augmentation data comprises:

identifying a plurality of segments along the data channel each corresponding to a distinct audio channel; and combining each portion of the perceptual coding carried by one of the segments with each portion of the augmentation data carried by said one of the segments to generate an intermediate signal that represents one of the audio channels.

20. The method of claim 17, wherein combining the perceptual coding with the augmentation data comprises:

identifying a segment along the data channel that corresponds to a single audio channel;

processing the augmentation data to determine a location of a residue for said audio channel and recovering the residue; and combining each portion of the perceptual coding carried by the segment with the residue to generate an intermediate signal that represents said audio channel at a resolution higher than the perceptual coding of the audio signal.

21. A processing system for a standard data channel, the standard data channel having a core layer and an augmentation layer, the processing system comprising:

a memory unit that stores a program of instructions;

a program-controlled processor coupled to receive a plurality the subband signals, and coupled to the memory unit for receiving the program, responsive to the program, the program-controlled processor determining a respective first quantization resolution for each subband signal in response to a first desired noise spectrum and quantizing each subband signal according to the respective first quantization resolution to generate a first coded signal, determining a respective second quantization resolution for each subband signal in response to a second desired noise spectrum and quantizing each subband signal according to the respective second quantization resolution to generate a second coded signal, generating a residue signal that indicates a residue between the first and second coded signals, and outputting the first coded signal on the core layer and the residue signal on the augmentation layer.

22. The processing system of claim 21, wherein, in response to the program, the program-controlled processor determines auditory masking characteristics of the subband signals according to psychoacoustic principles and establishes the first desired noise spectrum in response to the determined auditory masking characteristics.

23. The processing system of claim 21, wherein, in response to the program, the program-controlled processor determines the first quantization resolutions so that subband signals quantized according to the determined first quantization resolutions meet a data capacity requirement of the core layer.

24. The processing system of claim 21, wherein, in response to the program, the program-controlled processor outputs the first coded signal and residue signal in aligned configuration.

25. The processing system of claim 21, wherein, in response to the program, the program-controlled processor outputs on the data channel additional data that indicates a configuration pattern of the residue signal with respect to the first coded signal.

26. The processing system of claim 21, wherein, responsive to the program, the program-controlled processor determines the second desired noise spectrum by offsetting the first desired noise spectrum by a substantially uniform amount and outputs an indication of the substantially uniform amount in the standard data channel.

27. The processing system of claim 21, wherein, responsive to the program, the program-controlled processor generates a plurality of scale factors that represent the first coded signal and uses the generated scale factors to represent scale factors for the first coded signal.

28. The processing system of claim 21, wherein a subband signal quantized to respective second quantization resolution is represented by a scaled value comprising a sequence of bits, and wherein the subband signal quantized to respective first quantization resolution is represented by another scaled value comprising a subsequence of said bits.

29. A processing system for a multi-layer data channel, wherein a first layer of the data channel carries a perceptual coding of an audio signal and a second layer of the data channel carries augmentation data for increasing the resolution of the perceptual coding of the audio signal, the processing system comprising:

signal routing circuitry that receives the perceptual coding and augmentation data via the data channel;

a memory unit that stores a program of instructions; and a program-controlled processor coupled to the signal routing circuitry for receiving the perceptual coding and augmentation data, and coupled to the memory unit for receiving the program, and responsive to the program, generating a decoded signal.

30. The processing system of claim 29, wherein the program-controlled processor decodes the perceptual coding of the audio signal to generate the decoded signal.

31. The processing system of claim 29, wherein the program-controlled processor:

combines the perceptual coding with the augmentation data to generate a second coding of the audio signal having higher resolution than the perceptual coding of the audio signal; and decodes the second coding of the audio signal to generate the decoded signal.

32. The processing system of claim 29, wherein the signal routing circuitry receives the perceptual coding along a core sixteen bit layer of a data channel conforming to standard AES3 of the Audio Engineering Society, and receives the augmentation data along at least one four bit wide augmentation layer of the data channel.

33. The processing system of claim 29, wherein the program-controlled processor:

identifies a plurality of segments along the data channel each corresponding to a distinct audio channel; and combines each portion of the perceptual coding carried by one of the segments with each portion of the augmentation data carried by said one of the segments to generate an intermediate signal that represents one of the audio channels.

34. The processing system of claim 29, wherein the program-controlled processor:

identifies a segment along the data channel that corresponds to a single audio channel;

processes the augmentation data to determine a location of a residue for said audio channel and recovering the residue; and combines each portion of the perceptual coding carried by the segment with the residue to generate an intermediate signal that represents said audio channel at a resolution higher than the perceptual coding of the audio signal.

35. A medium readable by a machine, the medium carrying a program of instructions executable by the machine to perform a coding process, the coding process using a standard data channel that has a core layer and an augmentation layer, the process comprising:

receiving a plurality of subband signals;

determining a respective first quantization resolution for each subband signal in response to a first desired noise spectrum and quantizing each subband signal according to the respective first quantization resolution to generate a first coded signal;

determining a respective second quantization resolution for each subband signal in response to a second desired noise spectrum and quantizing each subband signal according to the respective second quantization resolution to generate a second coded signal;

generating a residue signal that indicates a residue between the first and second coded signals; and outputting the first coded signal in the core layer and the residue signal in the augmentation layer.

36. The medium of claim 35, wherein the first desired noise spectrum is established in response to auditory masking characteristics of the subband signals determined according to psychoacoustic principles.

37. The medium of claim 35, wherein the first quantization resolutions are determined responsive to subband signals quantized according to such first quantization resolutions meeting a data capacity requirement of the core layer.

38. The medium of claim 35, wherein the first coded signal and residue signal are output in aligned configuration.

39. The medium of claim 35, wherein additional data is output to indicate a configuration pattern of the residue signal with respect to the first coded signal.

40. The medium of claim 35, wherein the second desired noise spectrum is offset from the first desired noise spectrum by a substantially uniform amount, and wherein an indication of the substantially uniform amount is output in the standard data channel.

41. The medium of claim 35, wherein the first coded signal comprises a plurality of scale factors, and wherein the residue signal is represented by the scale factors of the first coded signal.

42. The medium of claim 35, wherein a subband signal quantized to respective second quantization resolution is represented by a scaled value comprising a sequence of bits, and wherein the subband signal quantized to respective first quantization resolution is represented by another scaled value comprising a subsequence of said bits.

43. A medium readable by a machine, the medium carrying a program of instructions executable by the machine to perform a method of processing data carried by a multi-layer data channel, wherein a first layer of the data channel carries a perceptual coding of an audio signal and a second layer of the data channel carries augmentation data for increasing the resolution of the perceptual coding of the audio signal, the method using a decoder and comprising:

receiving the perceptual coding and augmentation data via the data channel; and routing the perceptual coding of the audio signal to the decoder.

44. The medium of claim 43, further comprising decoding the perceptual coding of the audio signal.

45. The medium of claim 43, further comprising:

combining the perceptual coding with the augmentation data to generate a second coding of the audio signal having higher resolution than the perceptual coding of the audio signal; and decoding the second coding of the audio signal.

46. The medium of claim 43, wherein the perceptual coding is received along a core sixteen bit layer of a data channel conforming to standard AES3 of the Audio Engineering Society, and wherein the augmentation data is received along at least one four bit wide augmentation layer of the data channel.

47. The medium of claim 45, wherein combining the perceptual coding with the augmentation data comprises:

identifying a plurality of segments along the data channel each corresponding to a distinct audio channel; and combining each portion of the perceptual coding carried by one of the segments with each portion of the augmentation data carried by said one of the segments to generate an intermediate signal that represents one of the audio channels.

48. The medium of claim 45, wherein combining the perceptual coding with the augmentation data comprises:

identifying a segment along the data channel that corresponds to a single audio channel;

processing the augmentation data to determine a location of a residue for said audio channel and recovering the residue; and combining each portion of the perceptual coding carried by the segment with the residue to generate an intermediate signal that represents said audio channel at a resolution higher than the first coded signal.

49. A machine readable medium that carries encoded audio information, the encoded audio information generated according to a coding process that comprises:

receiving a plurality of subband signals;

determining a respective first quantization resolution for each subband signal in response to a first desired noise spectrum and quantizing each subband signal according to the respective first quantization resolution to generate a first coded signal;

determining a respective second quantization resolution for each subband signal in response to a second desired noise spectrum and quantizing each subband signal according to the respective second quantization resolution to generate a second coded signal;

generating a residue signal that indicates a residue between the first and second coded signals; and outputting the first coded signal in the core layer and the residue signal in the augmentation layer.

50. The medium of claim 49, wherein the first desired noise spectrum is established in response to auditory masking characteristics of the subband signals determined according to psychoacoustic principles.

51. The medium of claim 49, wherein the first quantization resolutions are determined responsive to subband signals quantized according to such first quantization resolutions meeting a data capacity requirement of the core layer.

52. The medium of claim 49, wherein the first coded signal and residue signal are output in aligned configuration.

53. The medium of claim 49, wherein additional data is output to indicate a configuration pattern of the residue signal with respect to the first coded signal.

54. The medium of claim 49, wherein the second desired noise spectrum is offset from the first desired noise spectrum by a substantially uniform amount, and wherein an indication of the substantially uniform amount is output in the standard data channel.

55. The medium of claim 49, wherein the first coded signal comprises a plurality of scale factors, and wherein the residue signal is represented by the scale factors of the first coded signal.

56. The medium of claim 49, wherein a subband signal quantized to respective second quantization resolution is represented by a scaled value comprising a sequence of bits, and wherein the subband signal quantized to respective first quantization resolution is represented by another scaled value comprising a subsequence of said bits.

* * * * *